US006539643B1

(12) United States Patent
Gleeson

(10) Patent No.: US 6,539,643 B1
(45) Date of Patent: Apr. 1, 2003

(54) SURFACE GROOVE SYSTEM FOR BUILDING SHEETS

(75) Inventor: James Albert Gleeson, Alta Loma, CA (US)

(73) Assignee: James Hardie Research Pty Limited (AU)

( * ) Notice: Subject to any disclaimer, the term of this patent is extended or adjusted under 35 U.S.C. 154(b) by 0 days.

(21) Appl. No.: 09/514,785

(22) Filed: Feb. 28, 2000

(51) Int. Cl.[7] ..... G01B 3/00; E04B 1/00
(52) U.S. Cl. ..... 33/563; 33/1 B; 52/105
(58) Field of Search ..... 33/1 B, 1 F, 1 G, 33/41.1, 562, 563, 565, 566; 52/105; 264/293; 428/43, 409, 537.7, 932

(56) References Cited

U.S. PATENT DOCUMENTS

| | | | | |
|---|---|---|---|---|
| 1,634,809 A | | 7/1927 | Weiss | |
| 1,856,932 A | | 5/1932 | Shaw | |
| 1,856,936 A | | 5/1932 | Turner | |
| 1,871,843 A | | 8/1932 | Ericson | |
| 1,930,024 A | | 10/1933 | Varden | |
| 1,943,663 A | | 1/1934 | Ericson | |
| 1,995,393 A | | 3/1935 | Manske | |
| 2,224,351 A | | 12/1940 | Kaye | |
| 3,284,980 A | | 11/1966 | Dinkel | |
| 3,527,004 A | | 9/1970 | Sorensen | |
| 4,203,788 A | | 5/1980 | Clear | |
| 4,298,647 A | | 11/1981 | Cancio et al. | |
| 4,380,564 A | | 4/1983 | Cancio et al. | |
| 4,465,729 A | | 8/1984 | Cancio et al. | |
| 4,730,398 A | | 3/1988 | Stanton | |
| 4,827,621 A | | 5/1989 | Borsuk | |
| 4,858,402 A | | 8/1989 | Putz | |
| 4,870,788 A | | 10/1989 | Hassan | |
| 4,924,644 A | | 5/1990 | Lewis | |
| 4,927,696 A | | 5/1990 | Berg | |
| 4,955,169 A | | 9/1990 | Shisko | |
| 5,268,226 A | | 12/1993 | Sweeney | |
| 5,282,317 A | | 2/1994 | Carter et al. | |
| 5,349,802 A | | 9/1994 | Kariniemi | |
| 5,477,617 A | | 12/1995 | Guy | |
| 5,511,316 A | * | 4/1996 | Fischer et al. | 33/562 |
| 5,673,489 A | | 10/1997 | Robell | |
| 5,842,280 A | | 12/1998 | Robell | |
| 5,924,213 A | | 7/1999 | Lee | 33/1 B |
| 5,950,319 A | * | 9/1999 | Harris | 33/1 B |
| 6,012,255 A | | 1/2000 | Smid et al. | 52/105 |
| 6,049,987 A | | 4/2000 | Robell | |

FOREIGN PATENT DOCUMENTS

| | | |
|---|---|---|
| EP | 0 482 810 | 4/1992 |
| TW | 282 800 | 8/1996 |
| WO | WO 00/08271 | 2/2000 |
| WO | WO 00/63506 | 10/2000 |
| WO | WO 01/26894 A1 | 4/2001 |

OTHER PUBLICATIONS

International Search Report, Mar. 19, 2000.

* cited by examiner

*Primary Examiner*—G. Bradley Bennett
(74) *Attorney, Agent, or Firm*—Knobbe, Martens, Olson & Bear, LLP

(57) ABSTRACT

The present invention involves building sheets with a plurality of grooves indented into a surface of the building sheet to provide a guide for cutting the building sheet along the grooves. Preferably, the grooves are arranged in a regularly repeating pattern and are spaced apart by a standard unit of measurement in order for a cutter to accurately size the building sheet to a precise dimension. A simple scoring knife is preferably used to score the sheet along the grooves, without the need for a straight edge, and the sheet is broken by simply bending the sheet of along the score mark. The grooves are preferably provided at a depth into the surface the sheet such that they do not substantially decrease the strength of the sheet or affect off-groove scoring. Thus, a score mark can be made between or across grooves without deflection of the mark into a groove and without breakage of the sheet along a groove when the sheet is bent.

79 Claims, 18 Drawing Sheets

SURFACE GROOVE SYSTEM FOR BUILDING SHEETS

BACKGROUND OF THE INVENTION

1. Field of the Invention

This invention relates to a method, apparatus and article enabling quickly and more easily cutting, breaking and installing building sheets, and more particularly, to building sheets having a surface groove system to guide a cutter without the need for a straight edge.

2. Description of the Related Art

Building sheets made of fiber cement and other materials are often used as backerboards for floors, countertops, walls, etc. For instance, backerboards for ceramic tiles are used for countertops to provide the water resistant, relatively rigid, dimensionally-stable foundation over which the tile is bonded during the installation. Conventionally, the backerboard is laid over an exterior grade sheet of plywood ½ to 1 inch thick and adhered thereto using an adhesive such as a dry-set portland cement mortar or latex-modified portland cement mortar thinset. The backerboard is also fastened to the plywood subfloor using nails or screws. Once the backerboard is in place, ceramic tile is laid over the backerboard and adhered thereto using a modified thinset or other suitable tile adhesives. Backerboards are installed in a similar manner for a number of other applications, such as tile backer for floor installations and wallboard installations where the material is installed direct to stud or exterior sheathing or paneling applications.

For these and other applications, building sheets must generally be sized and cut to an appropriate dimension for installation. For instance, tile backerboards must be appropriately sized and cut before placement over plywood subfloor. This can be a time consuming and labor-intensive process, requiring a number of different tools and great precision to size and cut a board to the desired dimension. Cutting of a backerboard typically requires using a straight edge and scoring knife to score the backerboard on one side, and then snapping the backerboard up against the edge of the straight edge to break the board along the score mark. It is often difficult (particularly for long cuts) to hold the straight edge in a fixed relationship to the material with one hand, and perform the scoring or cutting with the other hand. Resultant slippage can reduce the accuracy of the resulting cut. Alternatively, a circular saw with a carbide tipped blade or shears have also been used to cut backerboards.

To assist in determining a desired cut location, backerboards have been known to contain marker locations, for example markers 6 inches apart marked in ink, to indicate fastening locations for nails or drills. These markers can also provide a visual aid to enable a cutter to more easily locate a desired cutting location. U.S. Pat. No. 5,673,489 to Robell describes a gridded measurement system for construction materials such as wallboards wherein a plurality of horizontal and vertical unit measurement markings are positioned around the perimeter of the construction material surface to provide quick dimensional reference for sizing of the construction material. The construction material surface is filled with horizontal and vertical grid markings between the numbered unit measurement markings.

Construction boards with markings as described above, though generally assisting in visualizing cut locations, still do not significantly decrease the time and labor for installation. This is due in part to the fact that boards with markings still require the use of a straight edge or other tool to guide a cut mark across the board.

Accordingly, what is needed is a method and apparatus for reducing the time and improving the efficiency of installing building sheets such as backerboards, and more particularly, a building sheet that accomplishes some or all of these and other needs.

SUMMARY OF THE INVENTION

Briefly stated, the preferred embodiments of the present invention describe building sheets with a plurality of grooves indented into a surface of the building sheet to provide a guide for cutting the building sheet along the grooves. Preferably, the grooves are arranged in a regularly repeating pattern and are spaced apart by a standard unit of measurement in order for a cutter to accurately size the building sheet to a precise dimension. A simple carbide-tip scoring knife, such as supplied by Superior Featherweight Tools Company, Industry, Calif. is preferably used to score the sheet along the grooves, without the need for a straight edge, and the sheet is broken by simply bending the sheet along the score mark. The grooves are preferably provided at a depth into the surface of the sheet such that they do not substantially decrease the strength of the sheet or affect off-groove scoring and snapping. The design of the grooves is such that a score mark can be made between, across, or on a diagonal to the grooves and the material snaps so that the line of breakage follows the score mark and not the line of the nearby grooves.

Other indentations may also be provided into the surface of the building sheet. For instance, in one preferred embodiment, fastener indent areas may be provided at regularly spaced increments to receive nails or other fasteners. These indent areas allow the fastener to be inserted through the sheet with the head of the fastener being nailed or screwed flat or below the surface of the sheet. Edge markers may be indented along the edges of the sheet to further indicate desired measurement increments. Optionally, edges may be grooved, flat or set down. Set down areas at the edges of the sheet provide an area for nails, adhesives and joining tape to be placed onto the sheet without protruding above the surface of the sheet.

Thus, in one aspect of the present invention, a building sheet is provided. The sheet comprises a substantially flat board having a front surface and a back surface and a thickness defined there between. At least one surface groove is formed into one of the front surface and back surface. The groove defines a line of cutting adapted to guide a knifepoint across at least a portion of the board.

In another aspect of the present invention, the building sheet comprises a substantially flat board having a top edge, a bottom edge and opposing side edges, and opposing faces defined between the edges of the board. A surface grid system is provided on at least one of the opposing faces, the surface grid system including a plurality of cutting grooves indented into the face of the board that extend substantially across the face of the board in straight lines. The grooves are arranged in parallel and perpendicular to the edges of the board or to one another, and are capable of receiving a score mark for cutting and breaking the board.

In another aspect of the present invention, the building sheet comprises a substantially flat board having a front surface and a back surface and a top edge, bottom edge and opposing side edges. The board has a thickness defined between the front surface and back surface. At least one set down area is indented into one of said front surface and back surface. The at least one set down area is adapted to receive a fastener therein. In one embodiment, the at least one set down area includes a plurality of fastener guides arranged in a regularly repeating pattern across the surface of the board. In another embodiment, the at least one set down area includes an edge set down area adapted to receive a reinforcing tape therein.

In another aspect of the present invention, a building sheet construction is provided. This construction comprises a foundation layer having a front surface and a back surface, and a substantially flat board having a front surface and a back surface overlying the foundation layer. The back surface of the board overlies the front surface of the foundation layer. The front surface of the board has at least one preformed indentation into the surface thereof. At least one fastener having a head extends through the board into the foundation layer, wherein the fastener extends through an indentation such that the head of the fastener lies at or below the front surface of the foundation layer.

In another aspect of the present invention, a building sheet comprises a substantially flat board having opposing surfaces, and a plurality of indentations provided into at least one of said opposing surfaces. The board has a bending strength that has been reduced by no more than about 20%, more preferably about 10%, and even more preferably about 5% below than the bending strength of the same board without the plurality of indentations.

In another aspect of the present invention, a method of cutting a building sheet is provided. The building sheet is scored at a desired location on a surface of the sheet, the sheet having at least one cutting groove formed into the sheet. The scoring of the sheet forms a score mark in the surface. The sheet is bent along the score mark to break the sheet. In one embodiment, the sheet is scored such that the score mark lies within and substantially along a cutting groove. In another embodiment, the sheet is scored such that the score mark lies substantially outside of a cutting groove.

DETAILED DESCRIPTION OF THE PREFERRED EMBODIMENTS

Certain preferred embodiments of the present invention relate to a building sheet having a plurality of surface grooves provided therein that aid in cutting the sheet without the need for a straight edge. The building sheet is more preferably a backerboard for flooring or other surface treatments such as ceramic tile, countertops, walls and the like. However, it will be appreciated that the principles of the present invention may be applied to other types of building sheets, including, but not limited to, interior wallboard, wall panels, exterior sheathing, panel flooring, decking, ceiling panels, soffit panels, facade panels and general building and furniture flat panels.

Figure 1:
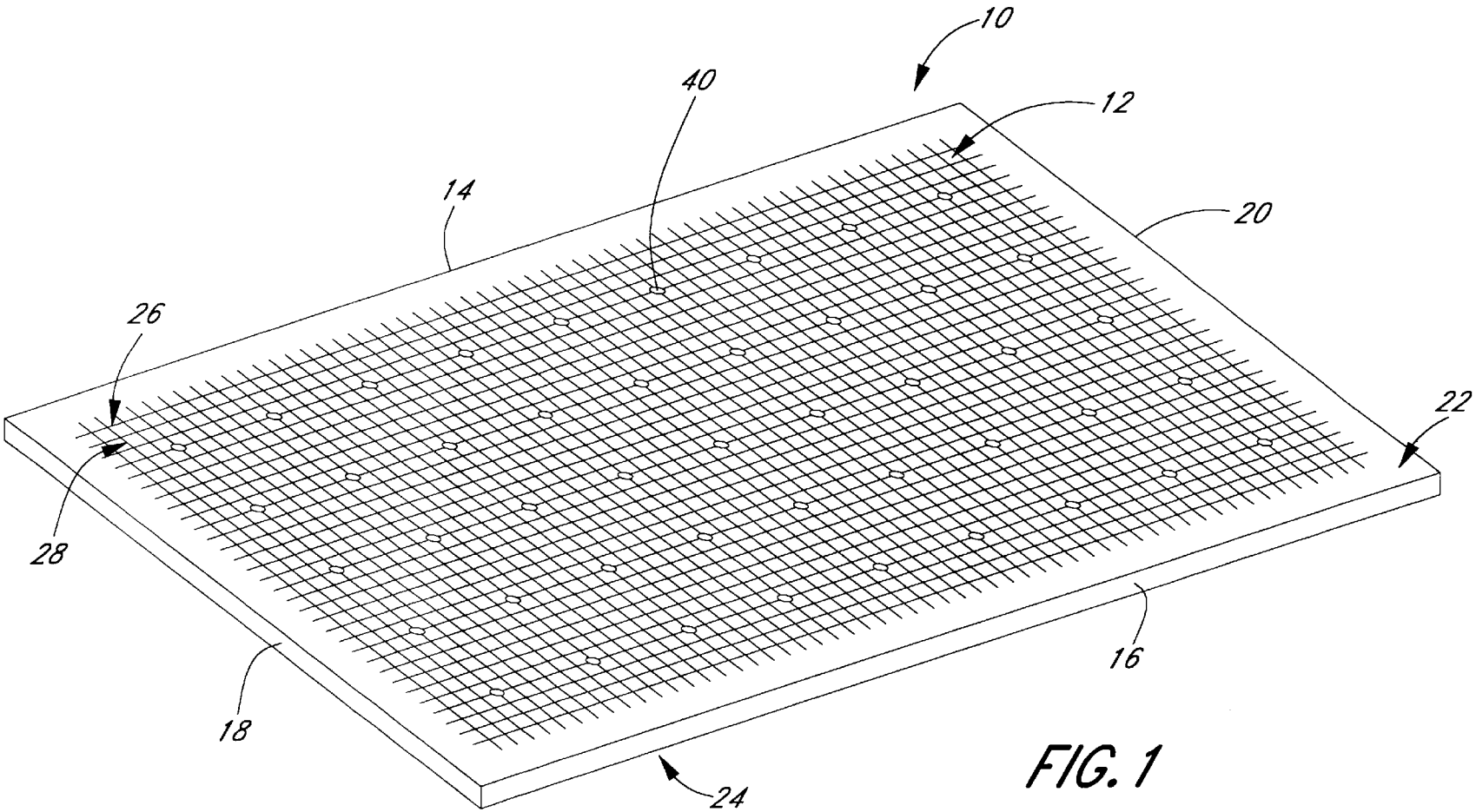
FIG. 1 is a perspective view of a backerboard having a plurality of intersecting surface grooves.

FIG. 1 illustrates one exemplary embodiment of a backerboard 10 having a plurality of surface grooves 12 provided thereon. The backerboard 10, before being sized and cut to its desired dimension for installation, is preferably a substantially flat, rectangular board having a top edge 14, a bottom edge 16, side edges 18 and 20, a front surface or face 22 and a back surface or face 24. The backerboard of the preferred embodiment is made of a fiber cement material, such as James Hardie Building Products' Hardibacker®, although other materials, such as plywood, hardboard, oriented strand board (OSB), engineered wood, fiber-matte-reinforced cement substrate sheets, cement boards, gypsum based wallboards and cement-bonded particle boards may also be used.

In one embodiment, the fiber cement material is about 20% to 60% Portland cement, about 20% to 70% ground silica sand, about 0% to 12% cellulose fiber, and about 0% to 6% select additives such as mineral oxides, mineral hydroxides and water. Platelet or fibrous additives, such as, for example, wollastonite, mica, glass fiber or mineral fiber, may be added to improve the thermal stability of the fiber cement. The dry density fiber cement sheet is typically about 0.8 g/cm$^3$ (low density) to about 1.3 g/cm$^3$ (medium density) to about 1.8 g/cm$^3$ or more (high density). Density can be modified by addition of density modifiers such as unexpanded or expanded vermiculite, perlite, clay, shale or low bulk density (about 0.06 to 0.7 g/cm$^3$ ) calcium silicate hydrates. The moisture content of the fiber cement is preferably from about 1% to about 30%. The art of manufacturing cellulose fiber reinforced cement is described in the Australian patent AU 515151.

Typical backerboard sizes in accordance with the preferred embodiments of the present invention are 3'×5', 4'×4' and 4'×8' having thicknesses of preferably ¼" or greater. Other nominal thicknesses of ⅜, 7/16, ½ and ⅝ inch may also be used.

The grooves 12 illustrated in FIG. 1 are preferably provided only on the front surface 22 of the backerboard 10, although it will be appreciated that grooves may be provided only on the back surface 24, or on both surfaces 22 and 24. Grooves may be desired for the back surface, for instance, when the front surface of the building sheet needs to be flat for painting or other applications. The grooves 12 illustrated in FIG. 1 preferably include two sets of grooves, namely a first set 26 that runs parallel to the top and bottom edges 14 and 16, and a second set 28 that runs parallel to the side edges 18 and 20 and perpendicular to the first set 26. It will be appreciated that grooves may be provided at different angles on the backerboard, and may run in single or multiple directions.

The grooves 12 preferably run in straight lines across the face of the board. In one embodiment, the grooves stop short of the edges of the board, as shown in FIG. 1. For example, a board that is 3'×5' in size may have grooves that extend to about 1½ inches from the edges of the sheet. This distance is preferably short enough to allow a freehand cut from the end of the groove to the edge of the sheet. By stopping the grooves short of the edge of the sheet, these edge areas without groove indentations may be used for joining adjacent sheets with adhesive and tape, as described below. These edge areas also may be used for placement of increment identifiers as described below.

Figure 2:
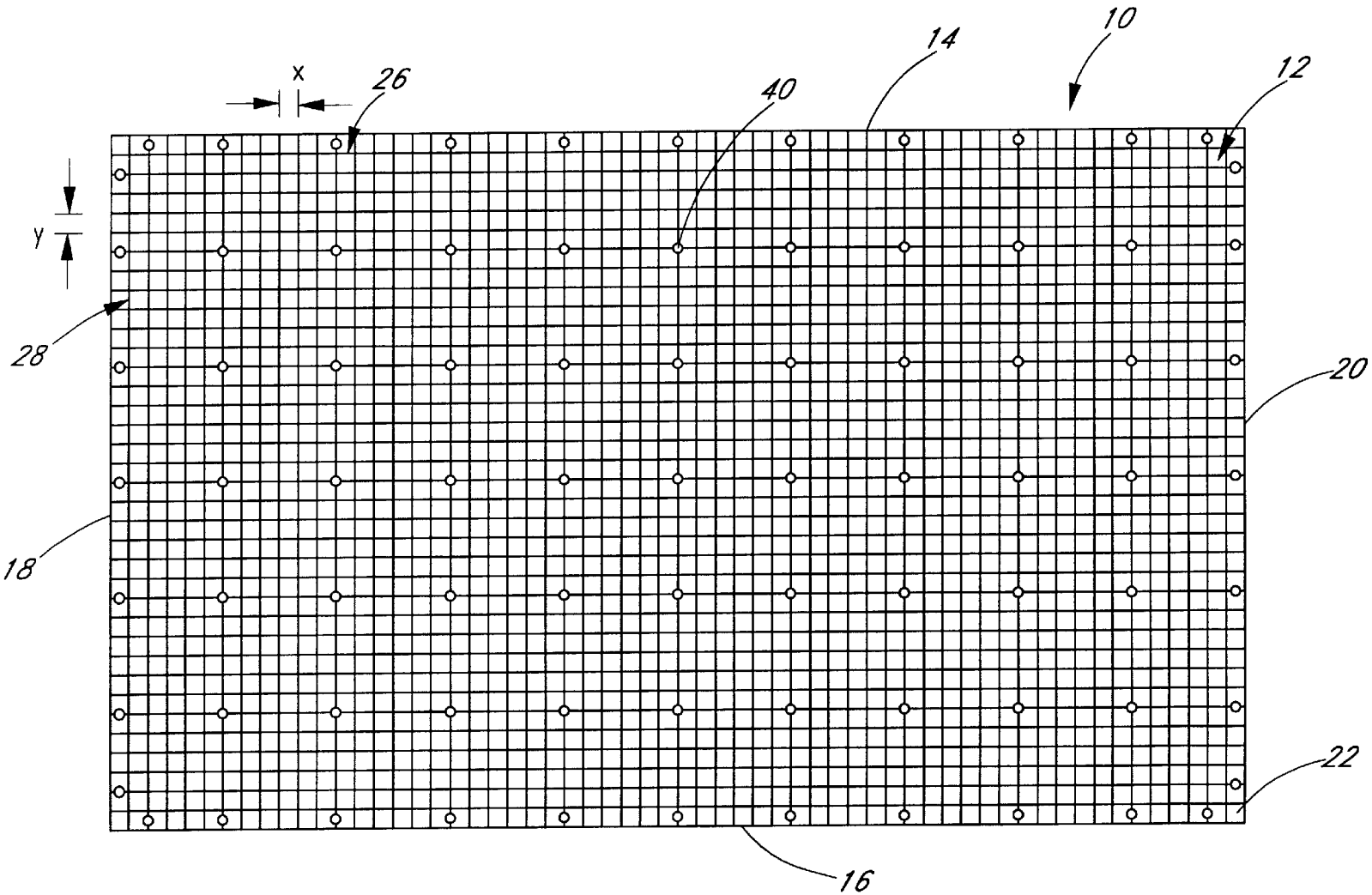
FIG. 2 is a top elevation view of a 3'×5' backerboard having a plurality of intersecting surface grooves with a 1" spacing.
Figure 3:
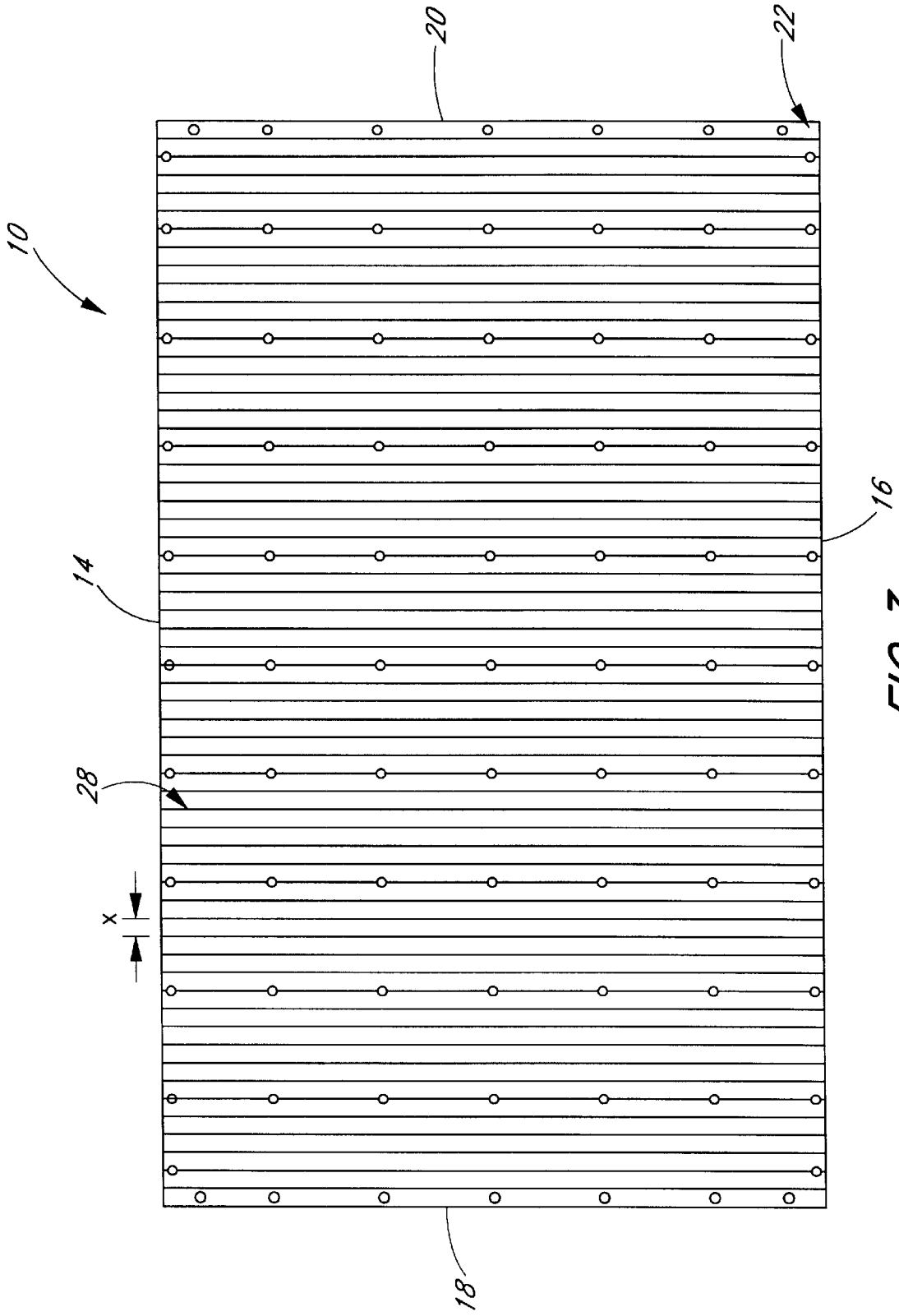
FIG. 3 is a top elevation view of a 3'×5' backerboard having a plurality of parallel surface grooves with a 1" spacing.

FIGS. 2 and 3 illustrate backerboards 10 that are preferably 3'×5' in size having a plurality of grooves 12 indented therein. FIG. 2 illustrates a board having both horizontal grooves 26 and vertical grooves 28 as in FIG. 1, except that the grooves in FIG. 2 extend all the way to the edges of the board. FIG. 3 illustrates an embodiment in which only vertical grooves 28 are provided across the board.

The grooves 12 in the embodiments above are preferably arranged in a regularly repeating pattern, such that there is uniform spacing between the grooves of the first set 26, and there is uniform spacing between the grooves of the second set 28. As illustrated in FIG. 2, when the groove spacing is preferably uniform, each groove of the first set 26 is set apart by a distance y, while each groove of the second set 28 is set apart by a distance x. More preferably, the distance x is equal to the distance y. The distances x and y are preferably selected to correspond with a standard measuring unit to enable a quick determination as to the size of the board along each of the grooves. For instance, in the embodiment of FIG. 2, the spacing x, y between the grooves is 1 inch. Similarly, for a board 10 as illustrated in FIG. 3, a standard spacing between the vertical grooves 28 may also be 1 inch. It will be appreciated that the grooves may be placed closer or farther together as desired. Grooves placed closer together enable greater accuracy in cutting and reduces the time taken to measure, mark and cut the sheet. Thus, smaller increments as low as 1/32" of an inch or less and as large as 12" or more may also be used. For instance, FIG. 4, described in further detail below, illustrates a 3'×5' backerboard 10 having intersecting surface grooves with a ¼" spacing.

The depth and shape of the grooves 12 are selected such that the grooves are capable of guiding a knifepoint, pencil or marker in a straight line along a groove. However, the depth of the grooves is preferably not so deep such that, when a diagonal score mark is made in the board surface across the groove lines, the board when bent breaks along a groove line instead of along the score mark. The depth of the grooves 12 is also preferably not so deep such that a diagonal score line across the groove lines causes a knifepoint to unintentionally track into the line of the groove. Moreover, the depth of the grooves is preferably not so deep such that the grooves substantially decrease the strength of the backerboard. For any particular board material and thickness, such a groove depth can be readily ascertained by simple empirical means, as described in more detail below.

Accordingly, in one embodiment the grooves 12 are preferably between about 0.001 inches and ¼ the thickness of the sheet. More preferably, for a backerboard having a thickness of ¼", the grooves 12 have a depth of about 0.01 to 0.06 inches. Even more preferably, the groove depth is preferably less than about 25% of the thickness of the board, more preferably less than about 15% of the thickness of the board.

Figures 5A, 5B, 5C, 5D, 5E, 5F:
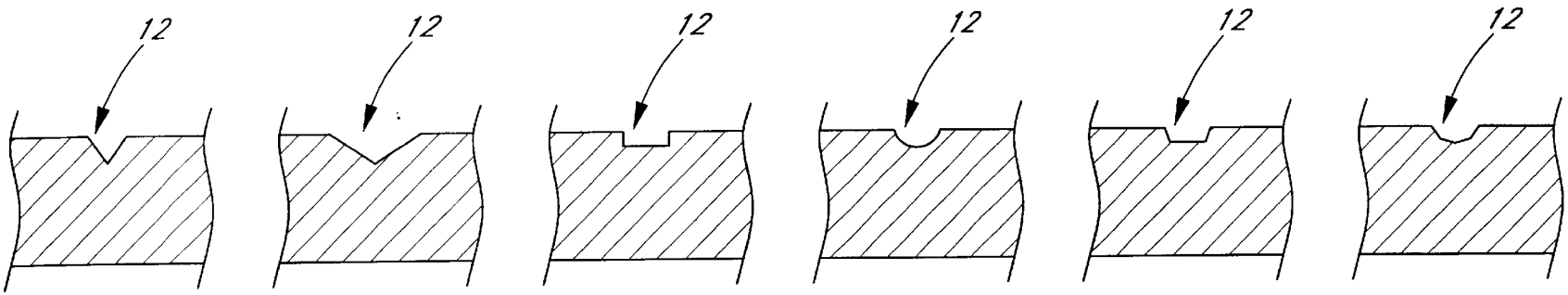
FIGS. 5A–5F are cross-sectional views illustrating different groove configurations for a backerboard.

The groove shape is capable of guiding a knife or marker such as a pencil, pen or texture. The cross-sectional shape of the grooves may be square, "V"-shaped, rectangular, semicircular, oval, ellipse, or combinations thereof. FIGS. 5A–5F illustrate several embodiments for groove configurations, which can be V-shaped (FIGS. 5A and 5B), rectangular (FIG. 5C), curved or semicircular (FIG. 5D), trapezoidal (FIG. 5E), or multisided (FIG. 5F). Where a V-shaped cutting knife is to be used, V-shaped groove configurations may be preferable. It will be appreciated that groove configurations other than those described herein are also possible.

Figure 4:
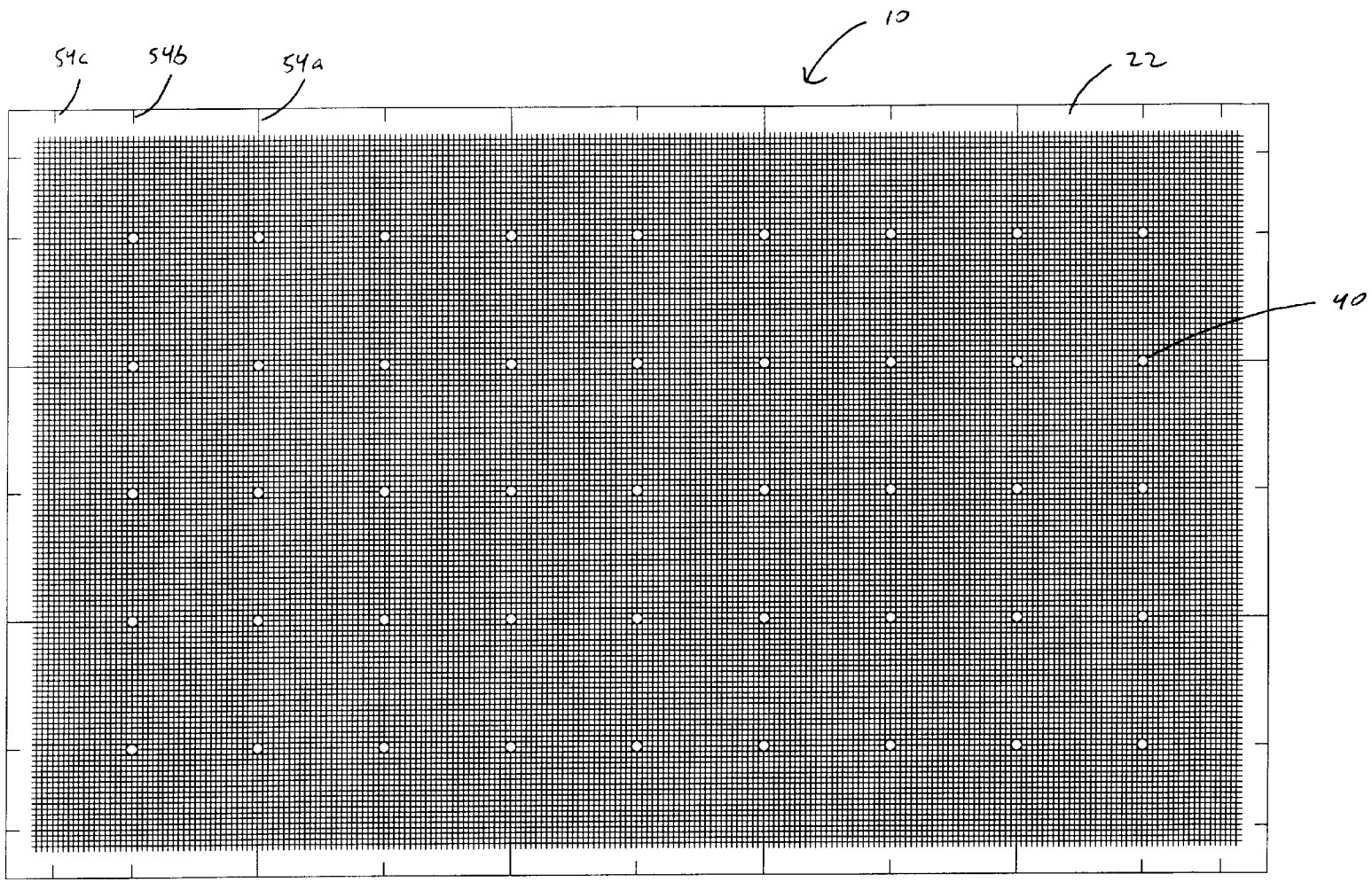
FIG. 4 is a top elevation view of a 3'×5' backerboard having a plurality of intersecting surface grooves with a ¼" spacing.
Figure 6:
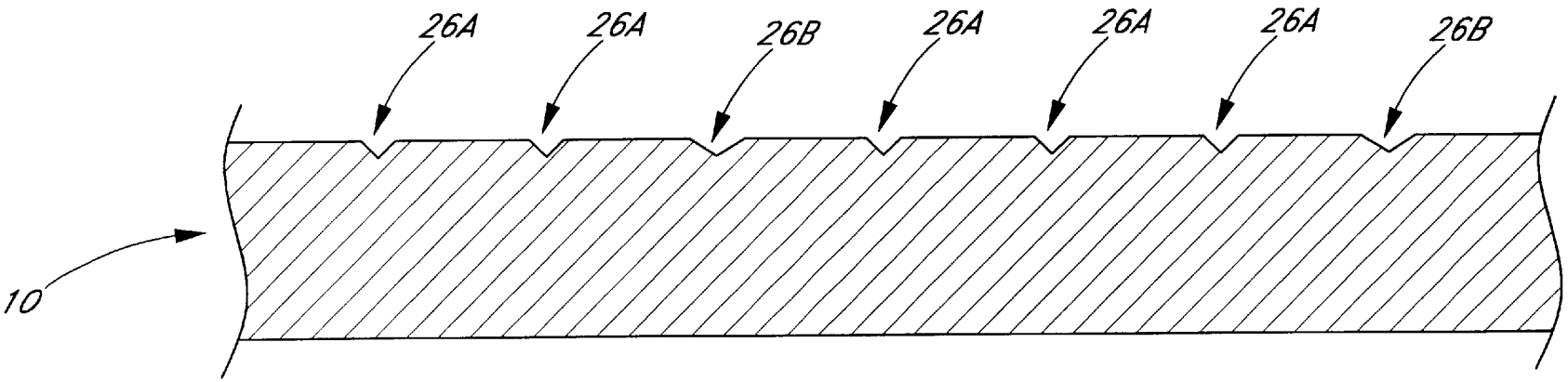
FIG. 6 is a cross-sectional view of a ¼" thick backerboard having differentiated V-shaped grooves.

The shape of specific grooves on a backerboard may optionally be different to the general groove design to facilitate easy recognition of incremental dimensions. For example, such a differentiation would enable the recognition of 1 inch increments on a board such as shown in FIG. 4 having a general ¼" increment groove spacing. FIG. 6 illustrates an exemplary differentiation of the groove shape wherein approximately 0.0313" wide by 0.02" deep V-shaped grooves **26*a* are placed at ¼" increments and approximately 0.0625" wide by 0.02" deep V-shaped grooves 26*b* are placed at 1" increments. The wider grooves 26*b*** at 1" increments make it easier to distinguish these grooves from the ¼" grooves. It will be appreciated that other variations in groove shape, size and incremental spacing are also contemplated. In addition, the differentiation between the grooves can be accomplished by marking or printing in or by selected grooves, as well as through varying the size or shape of the grooves.

Figure 7A:
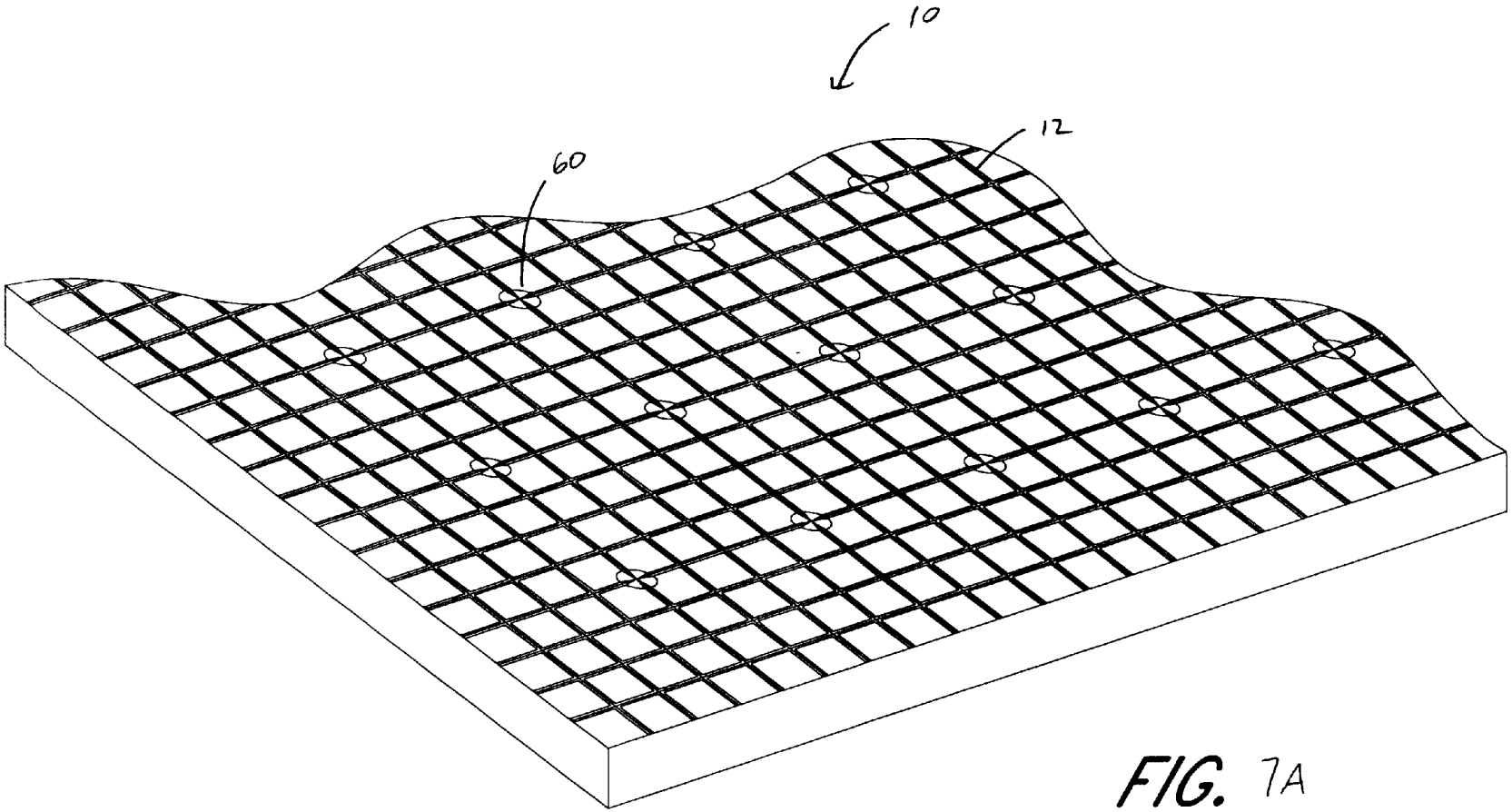
FIG. 7A is a perspective view of a backerboard having circular locators at the intersection of grooves at a 1 inch spacing.
Figure 7B:
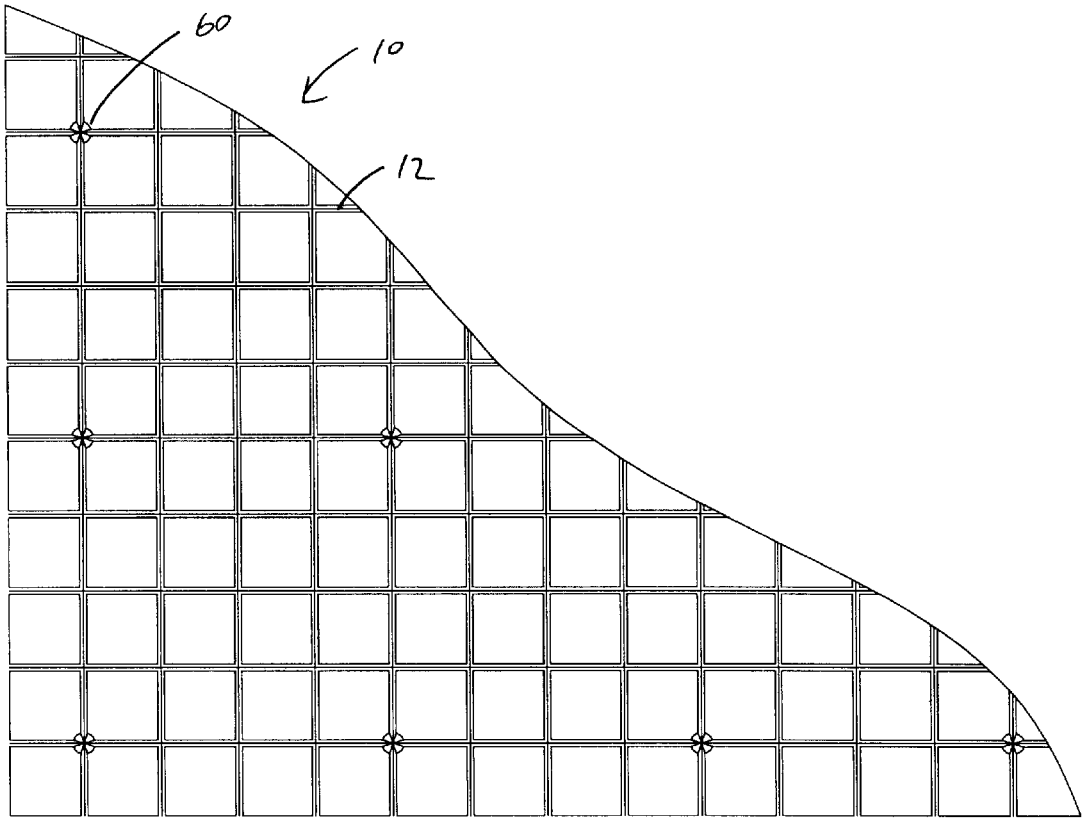
FIG. 7B is a top elevation view of a backerboard having circular locators at the intersection of grooves at a 1 inch spacing.

FIGS. 7A–7B illustrate another embodiment of a backerboard which enableseasy recognition of incremental grove spacing. As shown in FIGS. 7A and 7B, a backboard 10 is provided with evenly spaced parallel grooves 12 intersecting at right angles on the surface of the board. These grooves 12 are preferably V-shaped, and have the same size and shape throughout. In one embodiment, each of the grooves is spaced ¼ apart. To determine a desired spacing between grooves 12, locators 60 are preferably provided at the intersection of certain grooves, more preferably at regularly repeating increments across the board. For instance, in one embodiment, where the grooves are spaced at ¼" increments, the locators 60 are provided at 1 inch increments, and thus at every fourth grove both along the length and width of the board as shown in FIGS. 7A and 7B.

The locators 60 are preferably indented into the surface of the board of the intersection of the grooves. The shape of the locator 60 is preferably generally circular when viewed from above, as shown in FIG. 7B, such that the boundaries of the locator extend outside the lines of the grooves to make the locator more recognizable. In one embodiment, the diameter of the locator 60 is about ¼" as compared to a groove width of about 0.04 inches. The surface of the locator is preferably sloped inward toward the intersection of the grooves to prevent a knife point from accidentally tracking into the locator during cutting. More preferably, the sloping of the surface of the locator makes the shape of the locator generally conical. The depth of the locator is preferably no more than the depth of the grooves, which in one embodiment, is about 0.02".

Figure 8A:
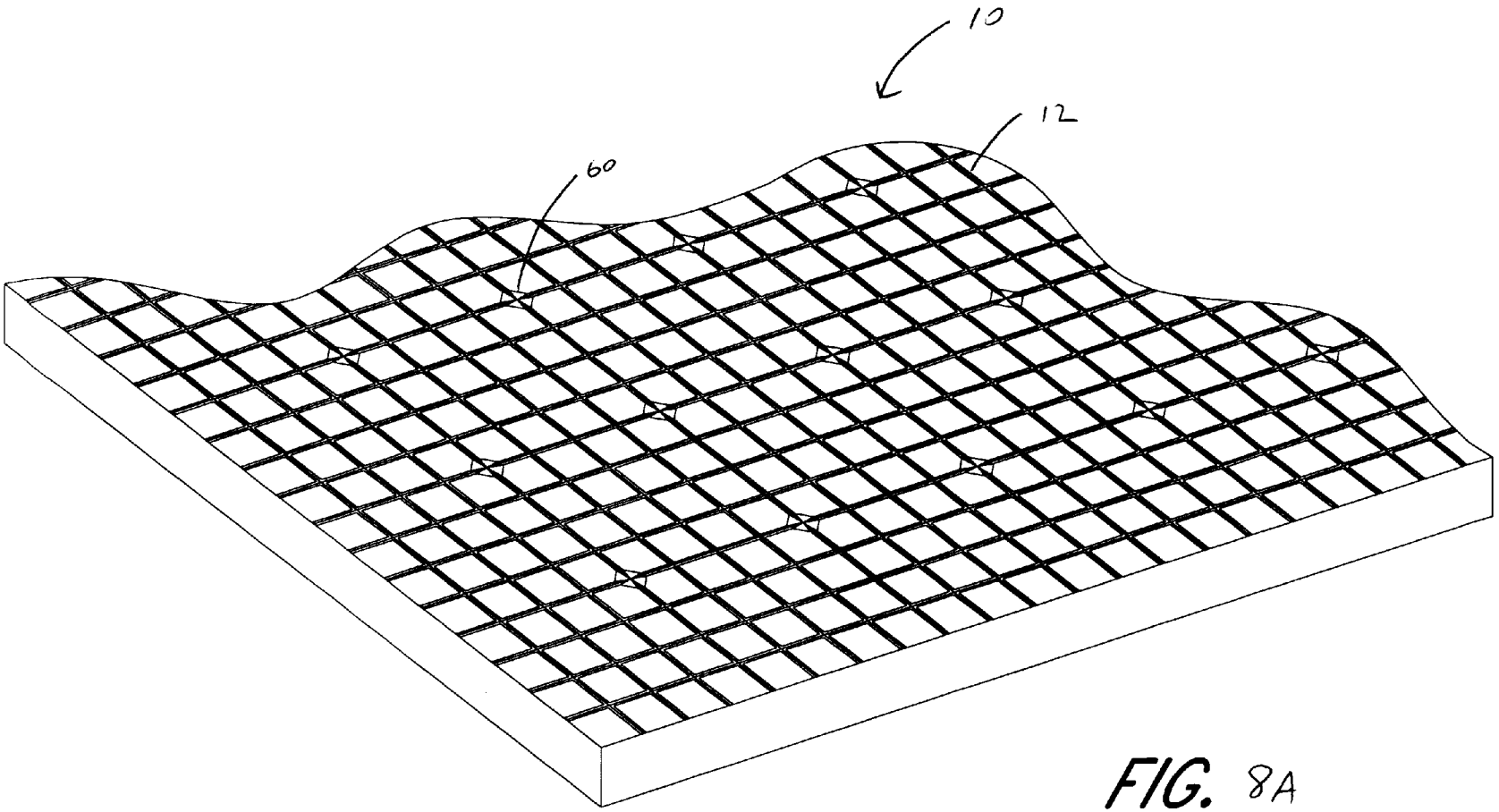
FIG. 8A is a perspective view of a backerboard having diamond-shaped locators at the intersection of grooves at a 1 inch spacing.
Figure 8B:
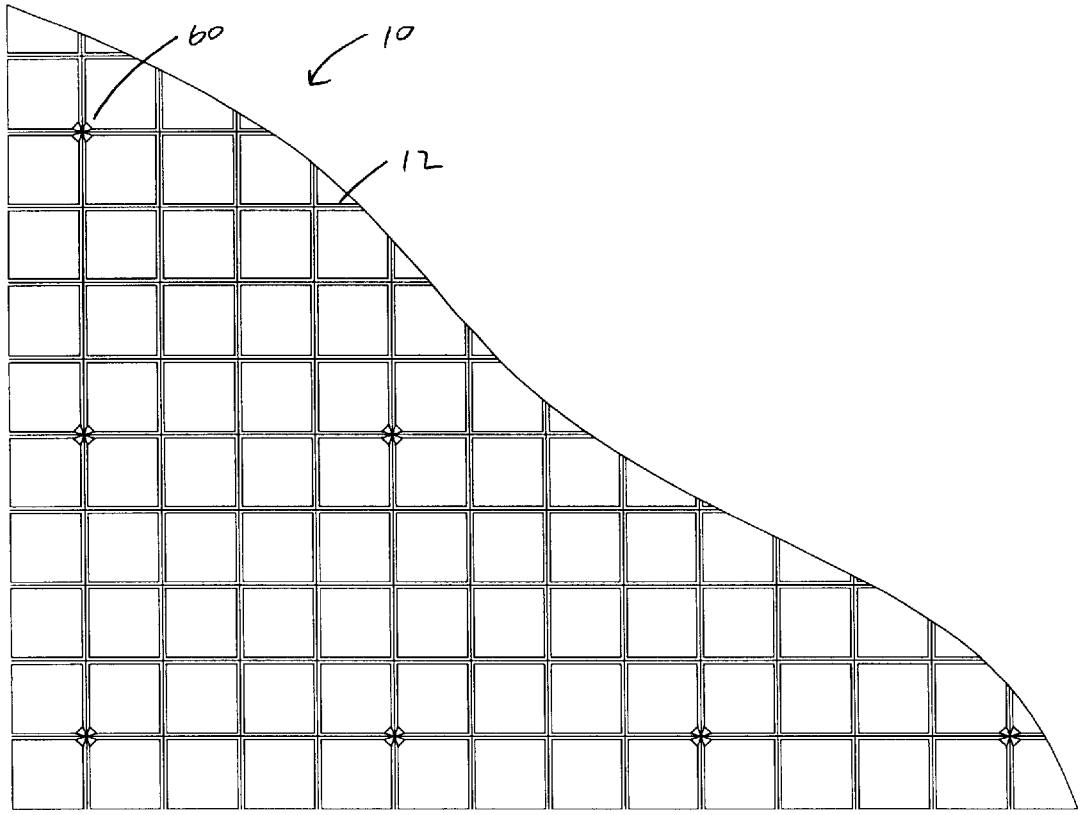
FIG. 8B is a top elevation view of a backerboard having diamond-shaped locators at the intersection of grooves at a 1 inch spacing.

FIGS. 8A–8B illustrate a similar embodiment to that shown in FIGS. 7A–7B, except that the locators 60 have a diamond or square shape rather than a circular shape when viewed from above. The edges of the diamond preferably extend between the perpendicular intersecting grooves, and in the embodiment shown have a length of about 0.03 inches. The locators 60 shown in FIGS. 8A–8B more preferably have sloped surfaces defining a substantially pyramidal shape, with the apex of the pyramid corresponding to the point where the grooves intersect.

It will be appreciated that other shapes may be used to indicate the locators of intersecting grooves on the board. In addition to shapes and indentations, printed indicia can also be used to mark the locations of predetermined intersecting grooves. More generally, any type of locator may be used to mark the location of intersecting grooves at repeating increments across the board, where the increments are determined as a multiple of the standard groove spacing on the board.

Figure 9A:
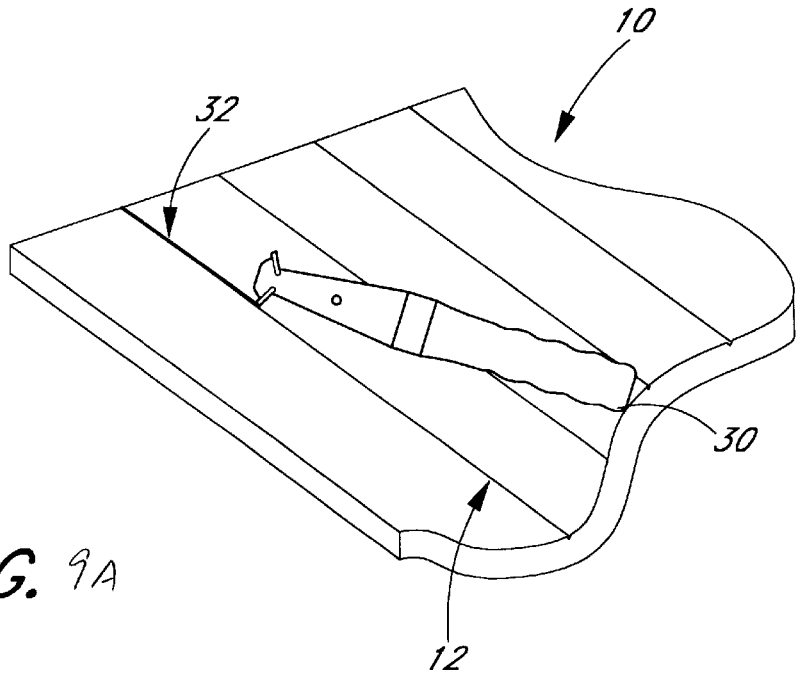
FIGS. 9A is a perspective view of a backerboard having a plurality of parallel grooves indented therein being cut with a scoring knife along the groove.
Figure 9C:
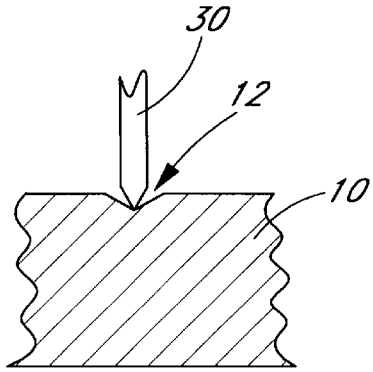
FIG. 9C is an enlarged cross-sectional view of the backerboard of FIG. 9B being cut along a V-shaped groove.
Figure 9B:
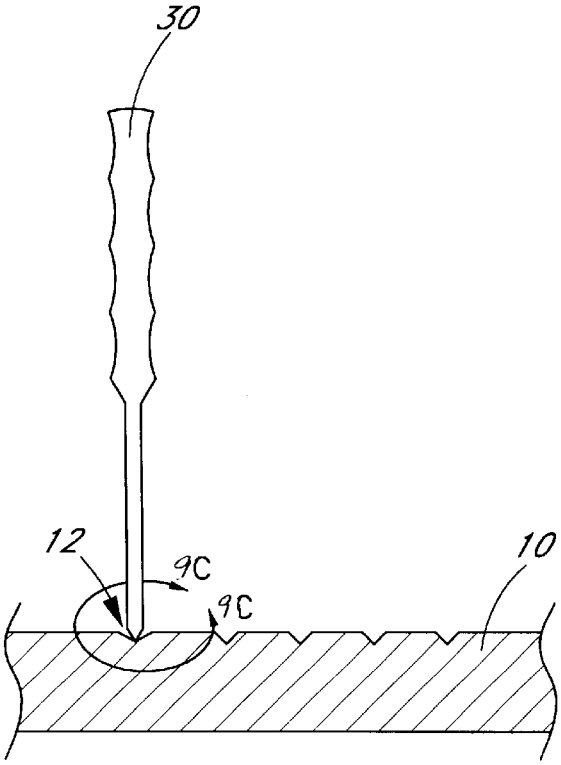
FIG. 9B is a cross-sectional view of the backerboard of FIG. 9A being cut along a V-shaped groove.

FIGS. 9A–9C illustrate one preferred method for cutting a backerboard 10 having at least one groove indented therein. A board 10 having a plurality of parallel grooves 12 is provided. A cutting knife such as a utility knife, more preferably a carbide-tipped score and snap knife 30, cuts the board along one of the grooves. Optionally, a pencil or marker may be used to mark the board along the grooves prior to cutting to indicate the location that the cutting knife or other tool should follow. The groove 12 guides the knife 30 such that a score mark 32 is made across the board within the groove without the need for a straight edge. After scoring the board along the groove, the board is bent along the score mark 32 to break the board.

Cutting and breaking a board in this manner greatly reduces the time, labor and tools required for sizing and installation of the board. The surface groove pattern enables the location of the desired score mark to be easily identified and the corresponding grooves enable a quick and easy score mark to be cut into the sheet so that the sheet can be snapped into the desired size. Thus, there is no need for a tape measure, line marking or straight edge. The only tool that is needed is a score knife that is light and easy to carry in a pocket or tool belt.

Figure 10:
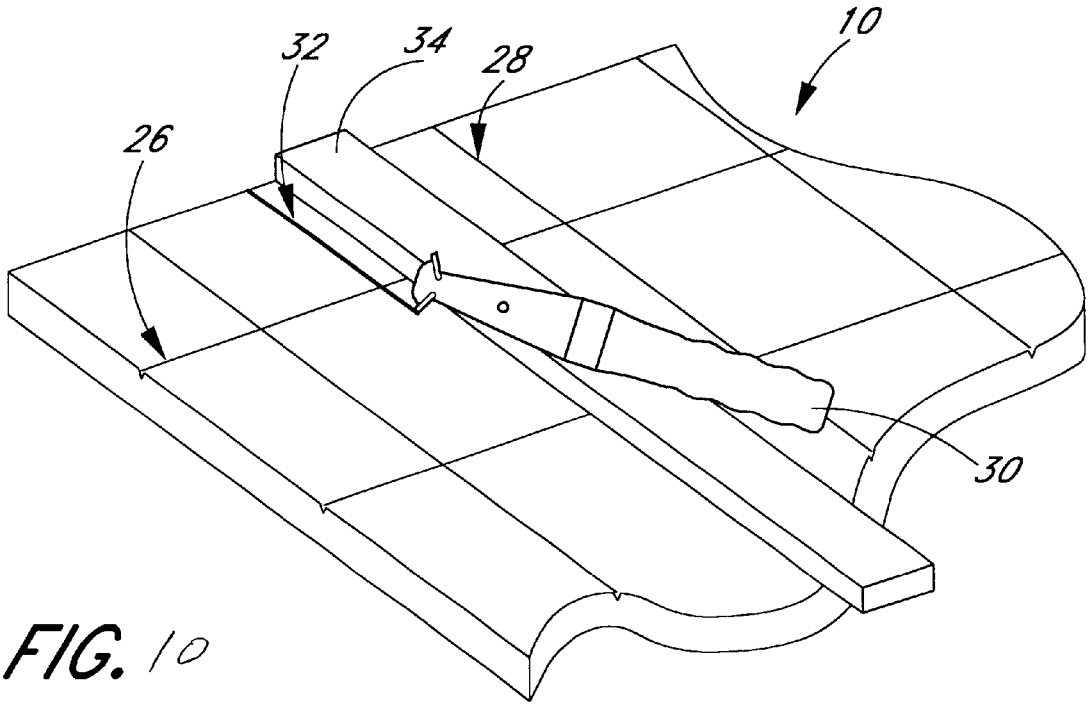
FIG. 10 is a perspective view of a backerboard having a plurality of grooves indented therein and a scoring knife cutting the board between the grooves.

As discussed above, the depth of the grooves is preferably selected so as not to substantially decrease the strength of the backerboard. The reduction in strength of the board due to the presence of grooves can generally be determined, for example, by scoring the board at a location away from a groove, such as the flat region between grooves or across grooves, or diagonally across the line of the grooves. When bending the board to break it, the board should break along the scored mark, and not along any of the grooves. Thus, FIG. 10 illustrates cutting a board in an alternative manner, in which a board 10 has a plurality of grooves 26 and 28 as described above. However, the scoring knife 30 is used to make a score mark 32 between grooves 28 and across grooves 26. This score mark may be made with the assistance of a straight edge 34 as shown, or may also be made freehand or with another tool.

Because of the preferred specially selected depth of the grooves 26, scoring the board across grooves 26 does not cause the score mark to accidentally track into the grooves. This remains true even when the score mark is made at an angle other than 90° to the groove lines, because the depth of the score mark is preferably deeper than the depth of the grooves. For example, the depth of the score mark may be between about 0.8 mm and 1.2 mm. When this board 10 is bent in order to break it, the board will break along the score mark and not along any of the grooves 26 or 28. Thus, it will be appreciated that one particular advantage of the preferred embodiments of the present invention is that the grooved backerboard need not be cut along the grooves, and therefore the cut board is not limited in size or shape to the arrangement of the grooves. The grooves act as a guide only and is not a limitation of the cutting method.

Testing has been performed to demonstrate that formation of the grooves on the board does not decrease substantially the bending strength of the board. A flat, single fiber cement sheet having a thickness of 6.7±0.2 mm was formed having regions with 0.02 inch deep grooves and regions without grooves. The sheets were cut into 250 mm×250 mm test specimens and equilibrated at 50±5% humidity and 73±4° F. The sheets were tested for bending strength using a three point bend test supported over a 165 mm span on a MTS mechanical testing machine. Ten specimens were tested, with the average results given below.

TABLE 1

Peak Loads of Grooved and Flat Backerboard

| | Grooved Surface Strength (Newtons) | Flat Surface Strength (Newtons) |
|---|---|---|
| Face Up | 667 | 700 |
| Face Down | 706 | 741 |

The results of this testing indicate that the strength of the board is not reduced by more than about 5% because of the grooves as compared to a flat surface backerboard. It will be appreciated that shallower or deeper groove depths will cause various reductions of the strength of a board. Thus, even boards that experience a greater reduction in the board's load carrying capacity, for example, up to about 10% and even up to about 20% because of the presence of the grooves are still considered to be useful and within the scope of the invention. More generally, it will be appreciated that boards having grooves indented thereon remain useful so long as the diminished load carrying capacity of the board does not make it difficult to make diagonal or off-groove cuts, or where it becomes difficult to handle the board without the board breaking.

The various groove shapes and sizes are preferably formed by processes such as machining, molding and embossing. Machining includes all wood and metal machining tools such as planers, routers, double end tendon machines, drills, lathes, spindle molders, circular saws, milling machines, etc. Molding the shapes in the material surface can be done during formation of an article in a flat casting mold or on an accumulation roller. Also casting, extrusion, injection-molding processes can also be used. Embossing the shapes in the material surface can be done after the material has been formed but preferably when the article is in a green state (plastic state prior to hardening). The embossing can be done by a patterned roller or plate being pressed into the surface or the sheet. Laser etching may also be used to form the grooves in the sheet.

More preferably, a patterned accumulator roll of a Hatschek process and a roll embossing process have been used to form the grooves in fiber cement board. In the embossing process, approximately 2,000 to 4,000 pounds per linear foot are required to emboss the grooves onto the green article.

It is an advantage of the accumulator roll formation process that a diagonal score and snap cut at an angle to the grooves is not hindered by the break line unintentionally tracking off to the line of the grooves. This is because the laminate formation of the material is not broken unlike a material post-cure machined groove. More particularly, the accumulator roll process compresses the laminate formation in the grooved region, thereby increasing the localized density around the groove, whereas a machining or cutting process to form the grooves tends to create defects which can lead to crack propagation and even breakage during handling. Thus, a board having grooves formed by the accumulator roll process exhibits greater bending strength than a similar board with grooves formed by machining.

Figure 11:
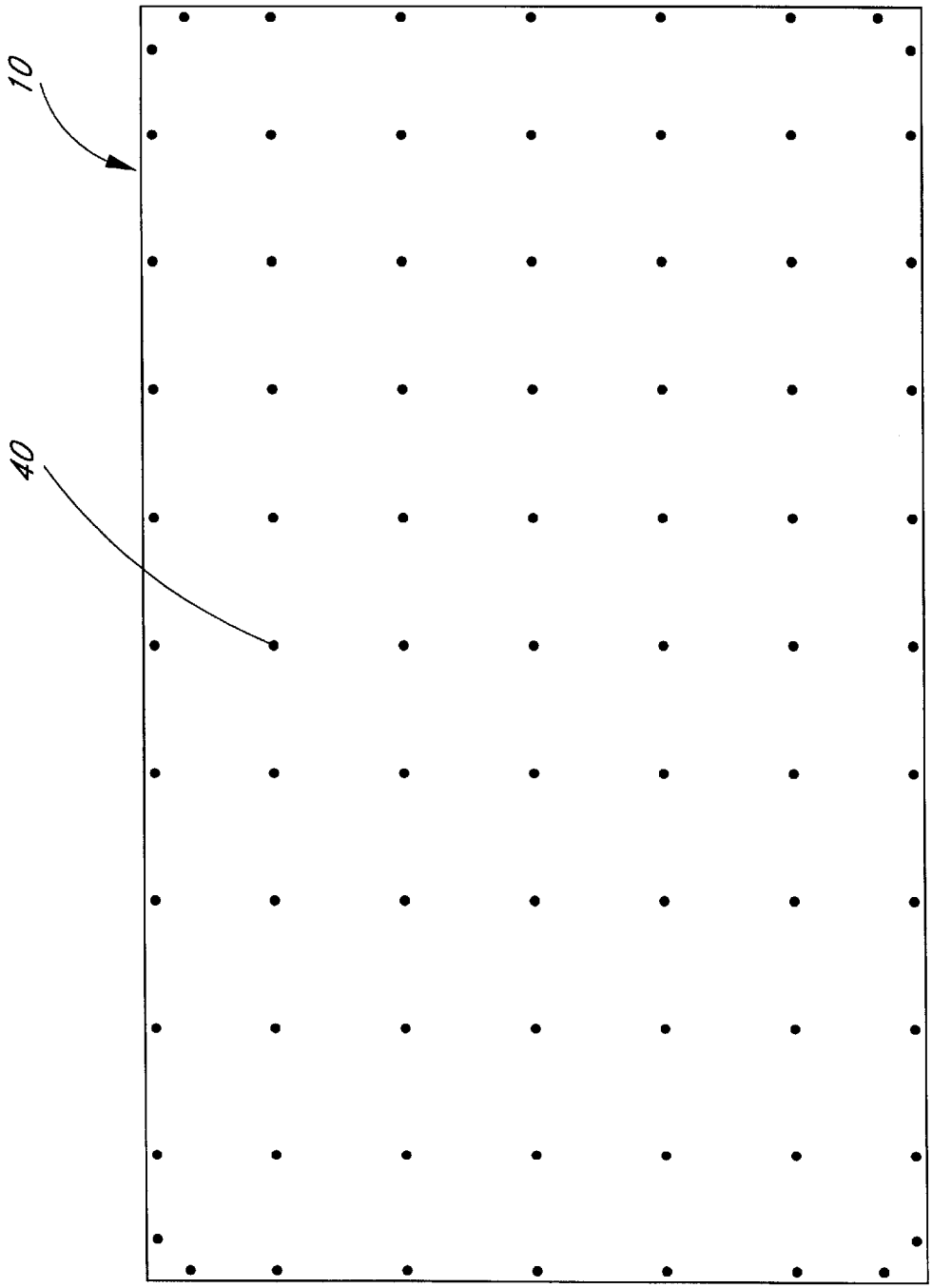
FIG. 11 is a top elevation view of a backerboard having a plurality of fastener indent areas.

Optionally, the backerboard embodiments illustrated in FIGS. 1–4 above also include guide patterns 40 which are used to indicate locations where fasteners such as nails can be placed to fasten the backerboard to underlying materials such as plywood. These guide patterns may be optionally formed or imprinted onto the face of the sheet as a guide for nail fastening, or may be indented below the surface of the board. Nail patterns, for instance, may be provided in boards having grooves, such as shown in FIGS. 1–4, or without grooves, as shown in FIG. 11. When provided on a board having grooves, such as in FIGS. 1–4, the nail patterns 40 preferably intersect the grooves and are spaced apart by a unit measurement (for instance, 6" in FIGS. 2–4 ). It will be appreciated that nail patterns 40 can also be provided with other spacing, and also between grooves on the backerboard.

In one preferred embodiment, the nail patterns 40 are indentations in the surface of the board to form nail guide indents. For a ¼" board, the depth of the nail guide indents is preferably between about 0.005 inches and ¾ the sheet thickness. More preferably, when the nail guide indents intersect with the grooves on the board, the depth of the indents is at least as deep as the grooves so as not to interfere with the scoring of the board through the grooves. In one embodiment, where the grooves are 0.02" deep, the nail guide indents are 0.04" deep.

Figure 12:
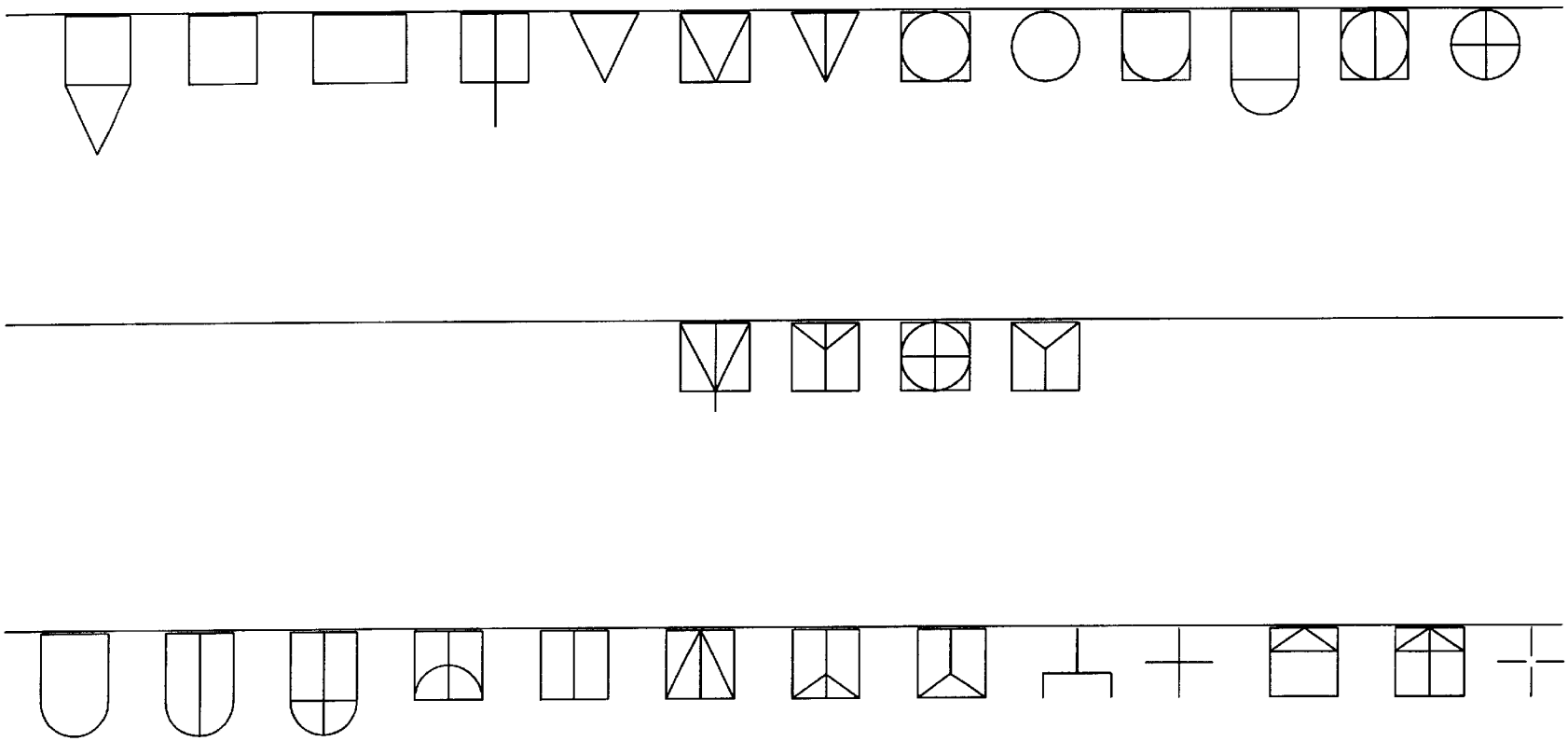
FIG. 12 is a top elevation view of a plurality of imprint or indent patterns that may be used as edge markers or fastener guides.

FIGS. 1–4 and 11 illustrate the nail guide pattern as being a circle. The diameter of the circle is preferably large enough to at least accommodate the head of the fastener to be inserted therein. As shown in the embodiment of FIG. 4, this circle preferably has a diameter of 0.25 to 1 inch, more preferably about 0.45". It will be appreciated that, whether the pattern is an imprint or is indented into the surface of the board, the pattern may have other shapes, such as a round or oval dot, a short line, a broken line, an intersection set of short lines, a circle, a semicircle, a triangle, a square, a rectangle, or a polygon. A variety of possible patterns are shown in FIG. 12, described in further detail below.

Figure 13A:
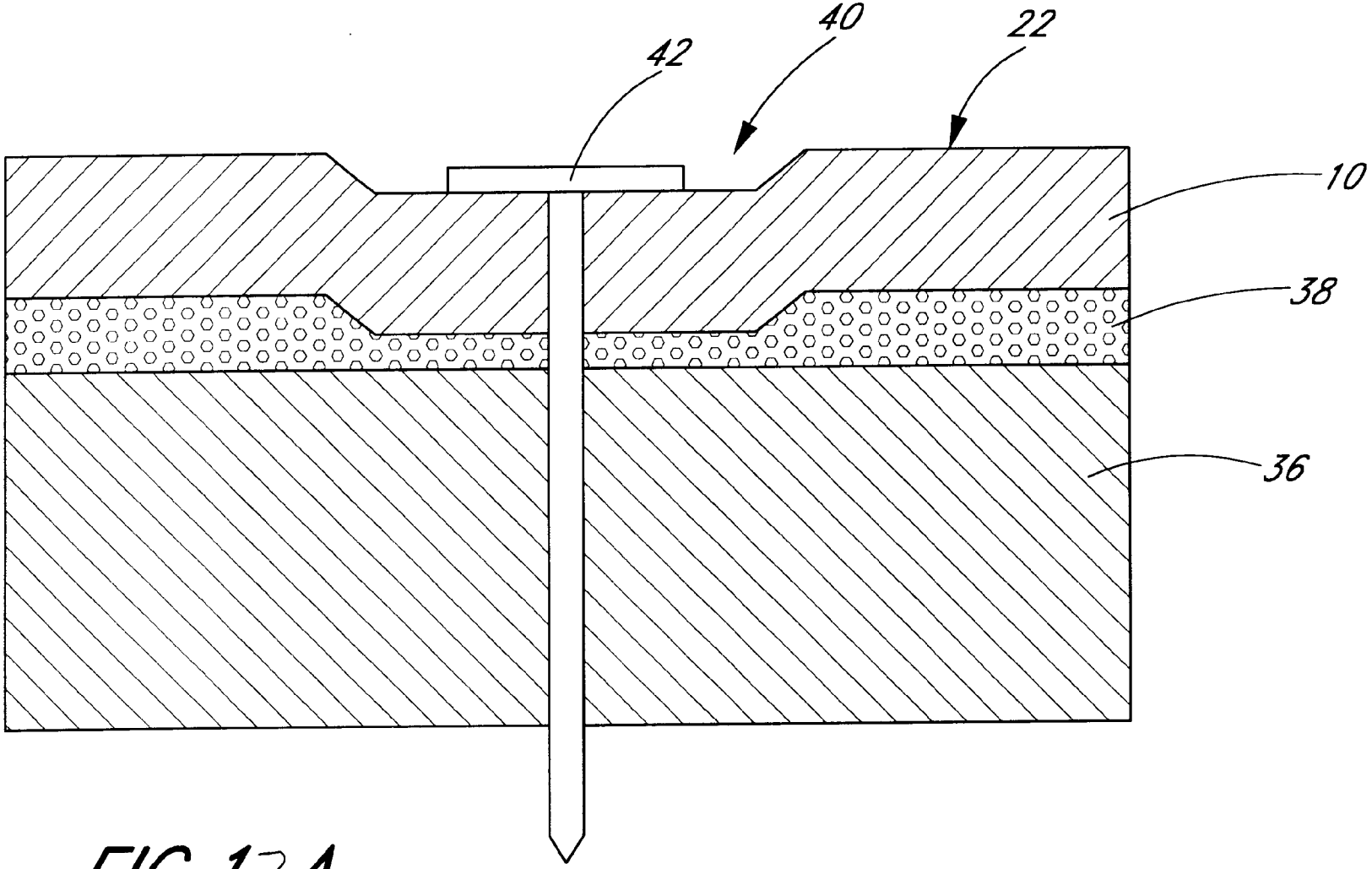
FIGS. 13A and 13B are cross-sectional views of a backerboard having fastener indent areas.
Figure 13B:
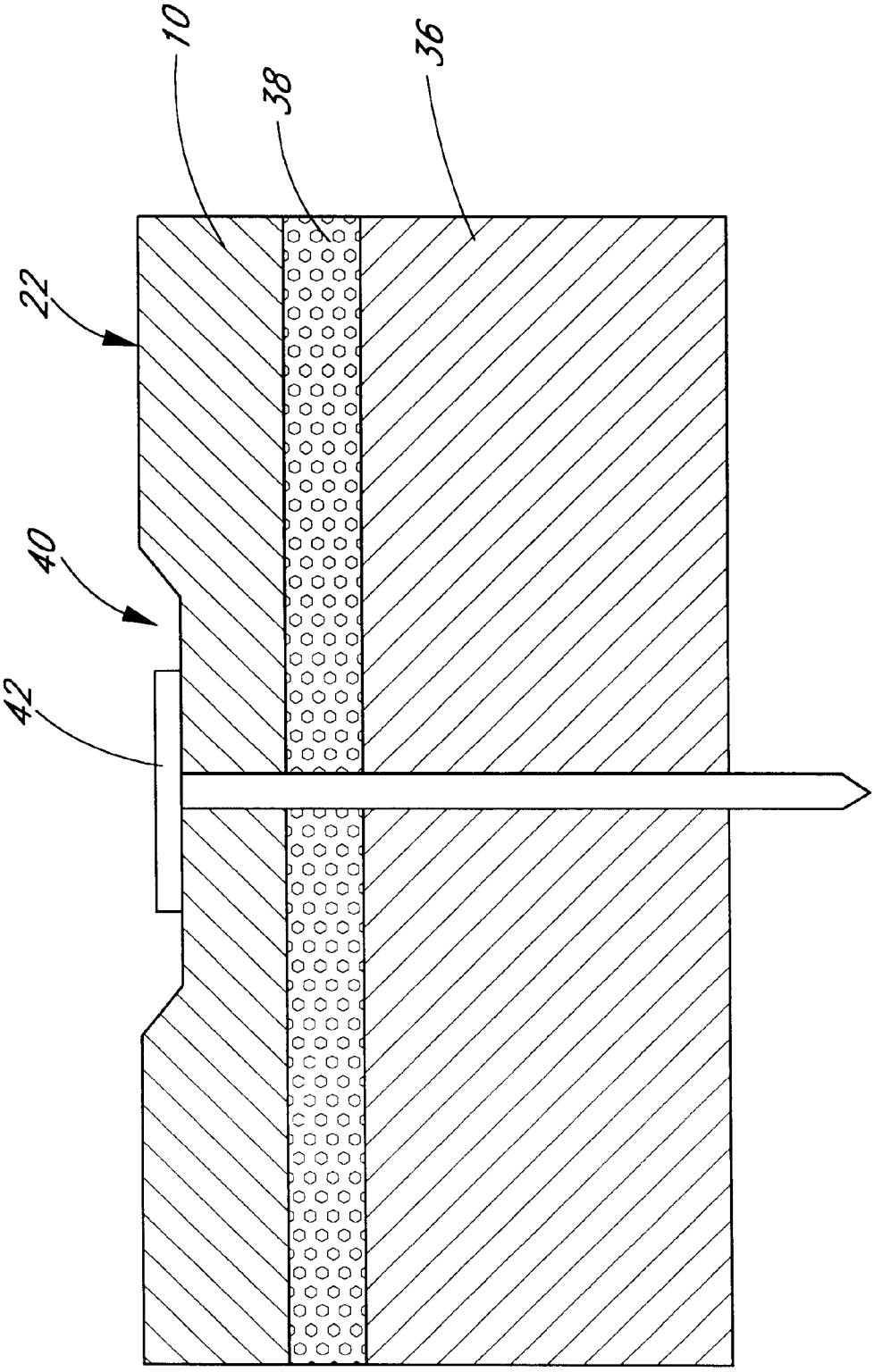

When the nail guide pattern is an indentation formed into the surface of the material, the shape and size of the indentation shall be preferably sufficient to accommodate the head of the nail below the main surface of the material. FIG. 13A illustrates one embodiment of a ¼" backerboard 10 fastened to a plywood flooring 36 using an adhesive, such as portland cement mortar thinset 38. A fastener or nail indent area 40 is provided on the top surface 22 of the backerboard for receiving fastener or nail 42, which is preferably a 1¼" corrosion resistant roofing nail. The nail indent area 40 is an indentation defining a set down area extending below the top surface 22 such that the head of the nail 42, when driven through the backerboard into the plywood, does not extend above the top surface 22. In the embodiment shown in FIG. 13A, the bottom surface 24 of the backerboard 10 also has a close to corresponding set down area 44 below the nail indent area 40 when formed using a Hatschek or similar process. Alternatively, the bottom surface 24 may be completely flat, as in FIG. 11B, such as when the indentation is formed by a machining or an embossing process.

The nail guides 40 illustrated in FIGS. 1–4 and 11 provide locations for nails in a regularly spaced arrangement around the board 10. However, near the edges of the board, the nail guides 40 are preferably placed slightly inward of the edge to accommodate fastening near the edges. As illustrated in FIG. 2, for nail guides 40 generally spaced 6" apart in a 3'×5' board, near the edges of the board the nail guides 40 are preferably placed ½" from the edges. More particularly, near the corners of the board the guides 40 are placed ½" from one edge and 2" from the other. It will be appreciated that these dimensions are purely exemplary, and therefore, other nail guide spacing may also be used.

Figure 14:
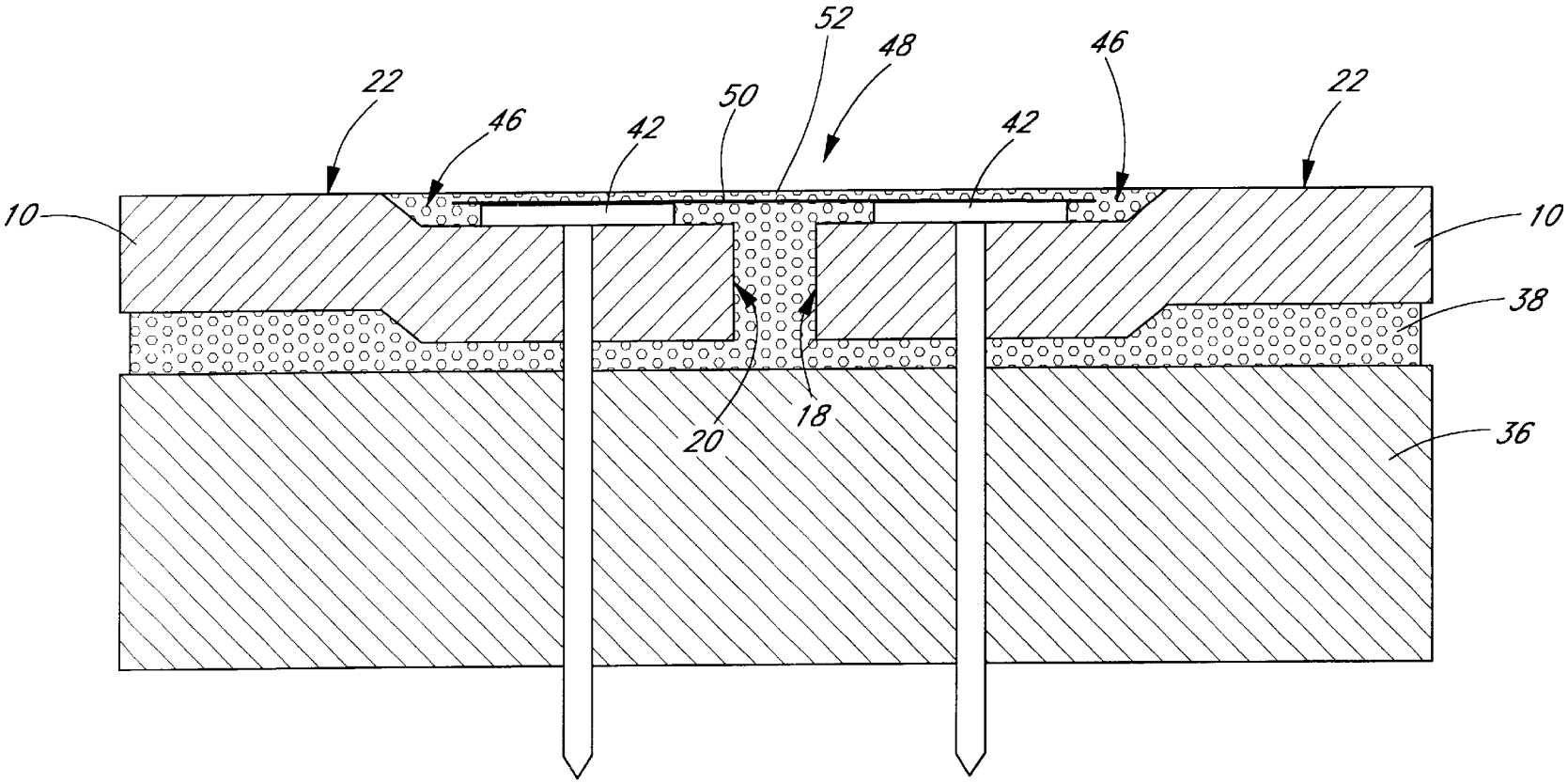
FIG. 14 is a cross-sectional view of one embodiment of a pair of backerboards having a set down area fastened to a plywood flooring.

FIG. 14 illustrates another optional embodiment in which the edges of the board have a set down area to accommodate nails, adhesive and alkali resistant fiberglass reinforcing tape found at the joint of two boards. When laying two backerboards adjacent each other, adhesive tape is often used to tape the joint along the edges of the adjacent backerboard. FIG. 14 illustrates such a joint 48 between two adjacent backerboards 10*a* and 10*b* fastened to plywood flooring 36 through adhesive 38. Near the edges 20 and 18 of backerboards 10*a* and 10*b*, respectively, nails 42 are driven through the backerboards to fasten the boards to the plywood 36. Reinforcing tape, such as an alkali resistant fiberglass backer tape 50, is placed over the head of the nails to join the boards together.

Figure 15A:
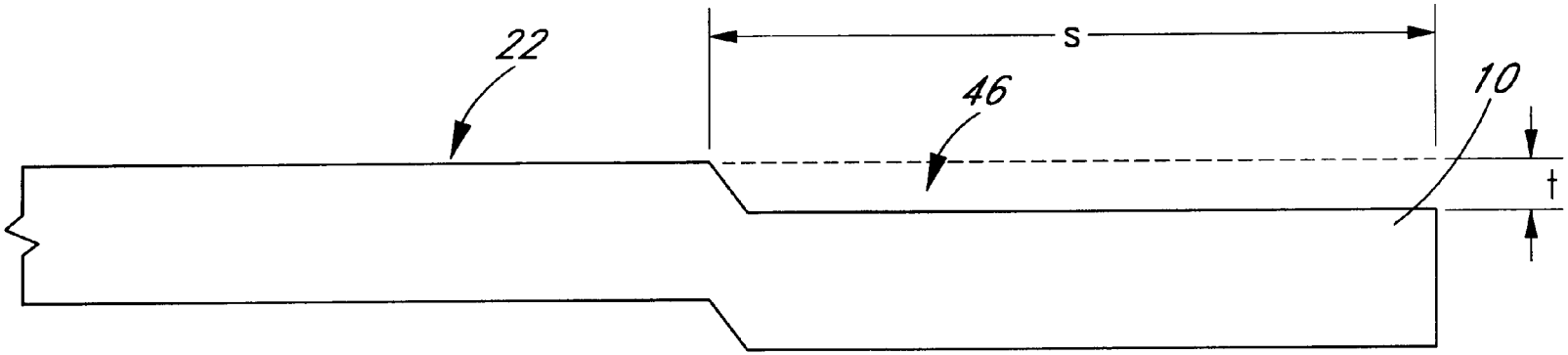
FIG. 15A is a side view of one embodiment a backerboard having a set down area on both its front surface and its back surface.
Figure 15B:
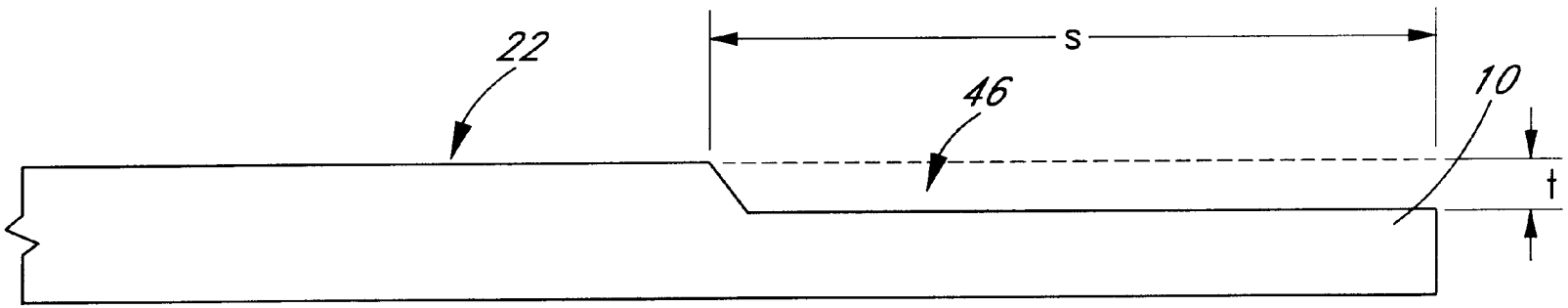
FIG. 15B is a side view of another embodiment of a backerboard having a set down area on its front face only.

The backerboards 10*a* and 10*b* each preferably has an edge set down area 46 on the front surface 22 thereof at the edge near the joint 48, where the front face 22 of the boards is recessed or set down by a distance t, illustrated in FIGS. 15A and 15B. This set down area 46 provides a location for setting the backerboard, using nails 42 as described above driven through the board into the plywood 36. Because of the set down area, the heads of the nails do not extend above the surface 22. In addition, the reinforcing tape 50 provided over the joint and over the nails 46 is completely within the set down area 46 and does not rise above surface 22. As shown in FIG. 14, the set down area 42 is preferably filled with portland cement mortar thinset 52 or other adhesive to provide a flat surface for the adhesion of tile or other building products. The set down thus has the advantage of providing a space for joint setting compounds, fasteners and reinforcing fabrics to fill to a level flat with the surface of the main sheet while enabling the strengthening of the connection between two sheets.

In the embodiment of FIGS. 14–15B, the plywood flooring 36 preferably has a thickness of about ¾", and the backerboards 10*a* and 10*b* each has a thickness of about ¼". The nails 42 are preferably about 1¼" in length, and the backer tape 50 is about 2" wide. The width s of the set down from the edge of the sheet shall be sufficient to accommodate reinforcing tape in the joint between two sheets are placed alongside each other. When the reinforcing tape is about 2 inches wide, the set down width is preferably greater than half this width, about 1 inch. Preferably, the widths of the edge set down is about 1.25 inches to allow for clearances. The width may be designed in other ways to suit the reinforcing tape width.

The depth t of the set down is preferably sufficient to accommodate a flat head fastener, such as a roofing nail or a bugle-head screw, plus reinforcing tape and joint setting compounds such that the joint can be set flat with the main flat surface of the sheet. Preferably, a set down t of about 0.04 inches is used, and more preferably is not less than about 0.005 inches and not greater than about ¾the thickness of a ¼" sheet. An advantage of this design is that nail or screw heads are accommodated by lower regions to ensure that the surface flatness is not interrupted by high points that may act as stress concentrators when loaded in application. The set down area also helps ensure that the nail is not overdriven into the material such that the nail's sheet pull through strength is reduced.

The embodiment illustrated in FIG. 14 depicts the backerboards 10*a* and 10*b* as having a bottom surface also having a set down depth. Alternatively, a board with this type of construction is also shown in FIG. 15A. FIG. 15B illustrates a similar board wherein the bottom surface 24 is completely flat.

It will be appreciated that in boards having an edge set down area, the grooves may or may not extend into this area because of the recessed depth of the area. The edge set down area may also be used for edge markers, as described below.

The nail guide indentations and other set downs may be formed into the boards by many processes such as forming the set down during formation of the sheet, using an accumulator roll, embossing the set down into the green-sheet or machining the set down out of the surface of the building sheet. These and other methods have been described above with respect to forming the grooves.

In another embodiment, accurate sizing of the board may further be assisted by providing edge markers on the surface of the board adjacent the grooves. These edge markers are preferably formed into the face of the sheet near the edges to indicate incremental distances or measurements. Furthermore, where the board has edge set down areas as described above, these edge markers may be provided in the set down areas. FIG. 12 illustrates several embodiments for marker shapes. As illustrated, the edge marker pattern can be an imprint or formed groove or indent in the shape of a round or oval dot, a short line, broken line, intersection set of short lines, circle, semicircle, triangle, square, rectangle, polygon, combinations thereof, or other shapes, characters or indicia. Edge markers may also be indented numbers to indicate certain increments.

Edge markers preferably designate a particular increment of distance, usually a multiple of the smallest increment, the smallest increment preferably being the distance between adjacent grooves. The marker is preferably formed to have the full shape formed into the surface of the board such that the surface of the marker shape is slightly lower than the surrounding sheet surface. Grooves as described above may extend all the way across the sheet to the edges through the markers, or may stop short of the edge markers.

In a preferred embodiment, FIG. 4 illustrates a backerboard 10 having edge markers indented into the top surface 22. Edge markers 54*a* and 54*b* as shown are provided at generally 6" increments for the 3'×5' backboard, although it will be appreciated that other increments, such as 1 inch or 12 inches, may also be used. The markers are preferably straight lines extending inward from the edges of the board. The markers are preferably indented below surface 22, more preferably 0.04" deep for a ¼" board. FIG. 4 also illustrates that different edge markers may be used around the board. Thus, as illustrated, longer line markers 54 a are provided at a 1' spacing around the board, while shorter line markers 54*b* are provided between the markers 54*a* at a 6" spacing. Near the corners of the boards markers 54*c* are provided to designate the minimum distance to the corners for nailing, which is typically about 2 inches. It will be appreciated that this marker shape and arrangement is purely exemplary, and thus other markers in different arrangements may be used to indicate measurement units on the board.

One particular advantage of the indentations described above, including the grooves, locators, nail indents, edge marker indents, set down areas, etc. is that these indentations provide a mechanical keying effect and increased surface area for bonding with an overlying material, such as ceramic tile. The indentations are thus capable of receiving adhesive therein. The greater contact area of the adhesive and the grooves' and other indentations' shape in the surface provides increased thinset/backer connection strength against tensile and shear forces.

Moreover, because in several embodiments the building sheet is used as an underlay layer, the grooves do not affect the utility of the material. This is significant because for many applications, grooves cannot be made in the face because the face must remain flat to obtain a smooth finished surface for painting typical of most interior wall finishes and/or other reasons. In one embodiment, the backerboards described herein need not have flat faces because these faces are used to adhere other materials. Moreover, even when a building sheet with a completely flat surface is desired, the principles taught herein may be used to indent grooves and/or other indentations on the other side of the sheet.

Generally, the above-described embodiments provide for quick and easy installation of a building sheet material by providing incremental visual reference for measuring the desired sheet-cutting pattern, then marking and cutting out the building sheet using an indented pattern or score guide in the surface of the sheet as a guide. The score guide makes the installation quicker and easier because fewer if any measured markings need to be made on the sheet. An indent pattern in the face of a sheet can be used as a guide for a score knife without requiring a straight edge to guide the cut or as a guide for a pencil or marker to mark the layout of the cut without requiring a straight edge to mark the cut layout. An indent pattern may also be provided to indicate appropriate nailing locations and desired cutting locations. The process involves forming an indented pattern into the surface of the material that provides a guide for cutting the sheets to size for installation. The pattern may be formed off a molded pattern or pressed or embossed or laser cut or machined into the surface of fiber cement sheet to produce a pattern of small straight grooves that provide a guide for measurement and cutting when installing sheet building material. Application of this invention is particularly advantageous to, but not limited to, the installation of cement-based building sheets, such as cement-based tile backer board.

General practice during installation of backerboard requires cutting sheets to fit over a floor or other area in a brick pattern layout. The cut-outs in a sheet are most commonly parallel or perpendicular to the sheet edges of the sheet. The pattern of grooves in the face of the sheet are parallel and perpendicular with the sheet edges. Considerable time and effort is therefore saved in not having to mark out two measurements for parallel nor require a straight edge to join the marks to form a line of cut. Furthermore, a straight edge or Plasterer's "T"-square device of sufficient stiffness to guide the knife is not required because the grooves guide the tip of the knife. Since no straight edge tool is require to guide or mark most of the cuts, fewer tools are needed to be located or moved around as part of the installation procedure, therefore speeding up the installation time and improving the ease of installation.

The embodiments illustrated and described above are provided merely as examples of certain preferred embodiments of the present invention. Various changes and modifications can be made from the embodiments presented herein by those skilled in the art without departure from the spirit and scope of the invention, as defined by the appended claims.

What is claimed is:

1. A building sheet, comprising:

a substantially flat board having a front surface and a back surface and a thickness defined therebetween;

a first plurality of parallel surface grooves formed into one of said front surface and back surface, said grooves being adapted to guide a knifepoint, pencil or marker across at least a portion of the board;

a second plurality of parallel surface grooves formed into one of said front surface and back surface, said grooves being adapted to guide a knifepoint, pencil or marker across at least a portion of the board, said second plurality of parallel surface grooves arranged at a substantially perpendicular angle to the first plurality of parallel surface grooves; and a plurality of fastener guides indented into one of said front surface and back surface, said fastener guides arranged in a regularly repeating pattern across the surface of the board and each adapted to receive a fastener therein.

2. The building sheet of claim 1, wherein the plurality of fastener guides are indented into the same surface as the grooves.

3. The building sheet of claim 1, wherein the board has a thickness of about ¼ of an inch.

4. The building sheet of claim 1, wherein the first plurality of parallel surface grooves and the second plurality of parallel surface grooves have a depth of between about 0.001 inches and ¾ the thickness of the board.

5. The building sheet of claim 4, wherein the first plurality of parallel surface grooves and the second plurality of parallel surface grooves have a depth of between about 0.02 and 0.06 inches.

6. The building sheet of claim 1, wherein each of the first plurality of parallel surface grooves and the second plurality of parallel surface grooves are set apart by a standard measurement unit.

7. The building sheet of claim 6, wherein the standard measurement unit is between 1/32" and 12".

8. The building sheet of claim 6, wherein the standard measurement unit is ¼".

9. The building sheet of claim 6, wherein the standard measurement unit is 1 inch.

10. The building sheet of claim 1, wherein each of the first plurality of parallel surface grooves and the second plurality of parallel surface grooves has a shape selected from the group consisting of V-shaped, rectangular, curved, trapezoidal and multisided.

11. The building sheet of claim 1, wherein the first plurality of parallel surface grooves and the second plurality of parallel surface grooves include at least one groove having a first visual appearance an at least one groove having a second visual appearance.

12. The building sheet of claim 11, wherein the at least one groove having a first visual appearance includes a plurality of parallel grooves extending at least partially across the board, having a first shape, and the at least one groove having a second visual appearance includes a plurality of parallel grooves extending at least partially across the board, having a second shape.

13. The building sheet of claim 12, wherein the plurality of parallel grooves having a first shape and the plurality of parallel grooves having a second shape are parallel to one another.

14. The building sheet of claim 13, wherein the plurality of parallel grooves having a first shape are set apart by a standard measurement unit.

15. The building sheet of claim 14, wherein the plurality of parallel grooves having a second shape are arranged between the plurality of parallel grooves having a first shape and are set apart by a standard measurement unit.

16. The building sheet of claim 15, wherein the plurality of parallel grooves having a first shape are set apart by 1", and the plurality of parallel grooves having a second shape are set apart by ¼".

17. The building sheet of claim 11, wherein the at least one groove having a first visual appearance and the at least one groove having a second visual appearance are both V-shaped.

18. The building sheet of claim 17, wherein the at least one groove having a first visual appearance is wider than the at least one groove having a second visual appearance.

19. A building sheet, comprising:

a substantially flat board having a top edge, a bottom edge and opposing side edges, and opposing faces defined between the edges of the board; and a surface grid system on only one of the opposing faces, the surface grid system including a plurality of cutting grooves indented into the face of the board that extend substantially across the face of the board in straight lines, the grooves being indented into the face of the board a depth of less than about 25% of the distance between the opposing faces, wherein the grooves are capable of receiving a score mark for cutting and breaking the board.

20. The building sheet of claim 19, wherein the grooves are arranged parallel and perpendicular to the edges of the board.

21. The building sheet of claim 19, wherein the grooves are arranged parallel and perpendicular to one another.

22. The building sheet of claim 21, further comprising a plurality of locators provided at intersections of the parallel and perpendicular grooves, and wherein the grooves are equally spaced apart.

23. The building sheet of claim 22, wherein the plurality of locators are provided at regularly repeating increments across the board, the increment being a multiple of the spacing of the grooves.

24. The building sheet of claim 23, wherein the grooves are spaced ¼" apart.

25. The building sheet of claim 24, wherein the locators are spaced 1 inch apart.

26. The building sheet of claim 22, wherein the locator is circular.

27. The building sheet of claim 22, wherein the locator is diamond shaped.

28. The building sheet of claim 19, wherein the grooves extend substantially to the edges of the board.

29. The building sheet of claim 19, wherein the grooves stop short of at least one edge of the board.

30. The building sheet of claim 19, wherein the board having surface grooves indented into the face thereof has a strength that is not less than about 95% of the strength of a board having the same size and dimension but without the grooves.

31. The building sheet of claim 19, wherein the grooves are indented into the board to a depth such that a knifepoint cutting across a groove at an angle to the groove does not substantially track into the groove, and such that a knifepoint scoring the board between grooves to form a score mark causes breakage of the board substantially along the score mark and not along any of the grooves.

32. The building sheet of claim 19, wherein the board is backerboard.

33. The building sheet of claim 32, wherein the backerboard is made of fiber cement.

34. The building sheet of claim 19, further comprising edge markers provided on the face of the board adjacent the surface grid system to indicate incremental distances between grooves.

35. The building sheet of claim 34, wherein the edge markers are indented into the surface of the board.

36. The building sheet of claim 19, further comprising a plurality of fastener guides provided on the face of the board containing the surface grid system.

37. The building sheet of claim 36, wherein the fastener guides are set apart by a standard measurement unit.

38. The building sheet of claim 37, wherein the fastener guides intersect at least one groove of the surface grid system.

39. The building sheet of claim 36, wherein the fastener guides are indented into the surface of the board.

40. The building sheet of claim 39, wherein the fastener guides are indented to a depth that is greater than the depth of the grooves.

41. The building sheet of claim 39, wherein the fastener guides are indented to a depth that is larger than the head of nail to be inserted in the fastener guide.

42. The building sheet of claim 19, wherein the substantially flat board has a set down area at at least one of the edges, wherein the surface of the set down area is below the surface of the face.

43. A building sheet, comprising:

a substantially flat board having a front surface and a back surface and a top edge, bottom edge and opposing side edges, the board having a thickness defined between the front surface and back surface; and at least one pre-formed set down area indented into one of said front surface and back surface, the at least one set down area adapted to receive a fastener therein.

44. The building sheet of claim 43, wherein the at least one set down area has a depth between about 0.005 inches and ¾ the board thickness.

45. The building sheet of claim 43, wherein the at least one set down area has a depth of about 0.04".

46. The building sheet of claim 43, wherein the at least one set down area comprises a plurality of fastener guides arranged in a regularly repeating pattern across the surface of the board.

47. The building sheet of claim 46, wherein each of the plurality of fastener guides is formed in the shape of a circle.

48. The building sheet of claim 43, wherein the at least one set down area comprises an edge set down area.

49. The building sheet of claim 48, wherein the edge set down area is sized to receive a reinforcing tape therein.

50. The building sheet of claim 43, wherein the at least one set down area is in the shape of a symbol or letter.

51. The building sheet of claim 43, wherein the at least one set down area is in the shape of a regular geometric form.

52. The building sheet of claim 43 ,wherein the at least one set down area is in the shape of an irregular geometric form.

53. A fiber cement building board, comprising:

a substantially flat board made of fiber cement and having first and second surfaces;

a plurality of grooves indented into the one of the first and second surfaces, said grooves including a first set that run in a first direction and a second set that run in a second direction generally perpendicular to the first set, wherein the grooves are capable of receiving a score mark for scoring and breaking the board.

54. The fiber cement building board of claim 53, comprising cellulose fibers.

55. A building sheet construction, comprising:

a foundation layer having a front surface and a back surface;

a substantially flat board having a front surface and a back surface overlying said foundation layer, the back surface of the board overlying the front surface of the foundation layer, the front surface of the board having at least one indentation into the surface thereof, and at least one fastener having a head extending through the board into the foundation layer, wherein the fastener extends through an indentation such that the head of the fastener lies at or below the front surface of the board.

56. The building sheet construction of claim 55, wherein the foundation layer is plywood.

57. The building sheet construction of claim 55, further comprising an adhesive joining the front surface of the foundation layer with the back surface of the board.

58. The building sheet construction of claim 55, wherein the at least one indentation extends to an edge of the board.

59. The building sheet construction of claim 58, further comprising a tape extending over the head of the at least one fastener.

60. The building sheet construction of claim 55, wherein the at least one indentation includes a plurality of indentations arranged in a regularly repeating pattern across the surface of the board.

61. A building sheet, comprising:

a substantially flat board having opposing surfaces; and a first set of grooves generally parallel to one another and a second set of grooves generally parallel to one another and perpendicular to said first set of grooves;

wherein the board has a bending strength of at least about 80% of the bending strength of the same board without the first set of grooves and the second set of grooves.

62. The building sheet of claim 61, wherein the board has a bending strength of at least about 90% of the bending strength of the same board without the first set of grooves and the second set of grooves.

63. The building sheet of claim 61, wherein the board has a bending strength of at least about 95% of the bending strength of the same board without the first set of grooves and the second set of grooves.

64. The building sheet of claim 61, further comprising a plurality of indentations adapted to receive an adhesive.

65. The building sheet of claim 61, further comprising fastener indent areas.

66. The building sheet of claim 61, further comprising edge markers.

67. The building sheet of claim 61, further comprising edge set down areas.

68. A method of installing a building sheet, comprising:

providing a building sheet having a first surface and a second surface defining a thickness therebetween, wherein at least one of said first surface and said second surface has a first set of generally parallel grooves and a second set of generally parallel grooves that are generally perpendicular to the first set of grooves formed into said surface;

placing the sheet adjacent a support structure; and fixing the sheet to the support structure.

69. The method of claim 68, wherein said building sheet includes a plurality of fastener guides on one of said first and second surfaces.

70. The method of claim 69, wherein said fixing the sheet to the support structure comprises driving one or more fasteners through the building sheet at the location of the fastener guides and into the support structure.

71. The method of claim 69, wherein said fastener guides comprise a plurality of evenly spaced indentations formed into the surface of the building sheet such that a head of a driven fastener resides within the indentation and is below or at the level of the building sheet surface.

72. The method of claim 68, wherein the first surface of the sheet is placed adjacent the support structure, and further comprising placing a building product over the second surface.

73. The method of claim 72, wherein said building product is tile.

74. The method of claim 68, where said support structure is a floor.

75. The method of claim 68, where said support structure comprises plywood.

76. The method of claim 68, wherein the first set of generally parallel grooves and the second set of generally parallel grooves comprise a plurality of guide grooves formed into the building sheet a depth of less than about 25% of the thickness of the sheet.

77. The method of claim 68, further comprising scoring the building sheet at a desired location on a surface of the building sheet, the scoring of the building sheet forming a score mark.

78. The method of claim 77, further comprising bending the building sheet along the score mark and breaking the sheet.

79. A backerboard, comprising:

a substantially flat board having a front surface and a back surface and a thickness defined therebetween; and a plurality of surface grooves formed into one of said front surface and back surface, said surface grooves including a first plurality of parallel grooves and a second plurality of parallel grooves, the second plurality of parallel grooves being generally perpendicular to the first plurality of parallel grooves, wherein the surface grooves are capable of receiving a score mark for scoring and breaking the board.

* * * * *